US008986469B2

(12) United States Patent
Vecchio et al.

(10) Patent No.: US 8,986,469 B2
(45) Date of Patent: Mar. 24, 2015

(54) AMORPHOUS ALLOY MATERIALS

(75) Inventors: Kenneth S. Vecchio, San Diego, CA (US); Justin Cheney, Oak Park, CA (US); Hesham Khalifa, San Diego, CA (US)

(73) Assignee: The Regents of the University of California, Oakland, CA (US)

( * ) Notice: Subject to any disclaimer, the term of this patent is extended or adjusted under 35 U.S.C. 154(b) by 881 days.

(21) Appl. No.: 12/741,818

(22) PCT Filed: Nov. 10, 2008

(86) PCT No.: PCT/US2008/083063

§ 371 (c)(1),
(2), (4) Date: Nov. 16, 2010

(87) PCT Pub. No.: WO2009/062196

PCT Pub. Date: May 14, 2009

(65) Prior Publication Data

US 2011/0048587 A1 Mar. 3, 2011

Related U.S. Application Data

(60) Provisional application No. 60/986,981, filed on Nov. 9, 2007.

(51) Int. Cl.
*C22C 45/02* (2006.01)
*C21D 1/26* (2006.01)
(Continued)

(52) U.S. Cl.
CPC . *C22C 45/02* (2013.01); *C21D 1/26* (2013.01); *C22C 1/002* (2013.01); *C22C 1/0458* (2013.01);

(Continued)

(58) Field of Classification Search
None
See application file for complete search history.

(56) References Cited

U.S. PATENT DOCUMENTS 2,838,395 A 6/1958 Rhodin
3,856,513 A 12/1974 Chen et al.

(Continued)

FOREIGN PATENT DOCUMENTS

JP 2001-152301 A 6/2001
JP 2005-336543 A 12/2005

(Continued)

OTHER PUBLICATIONS

Takaki, S. et al., "Ultra-Purification of Electrolytic Iron by Cold-Crucible Induction Melting and Induction-Heating Floating-Zone Melting in Ultra-High Vacuum", Materials Transactions, JIM, vol. 41, No. 1, 2000, pp. 2-6.*

(Continued)

*Primary Examiner* — George Wyszomierski
(74) *Attorney, Agent, or Firm* — Perkins Coie LLP

(57) ABSTRACT

Design and fabrication processes and compositions for bulk metallic glass materials. Examples of bulk metallic glasses based on the described compositions may contain a high atomic percent of titanium or iron, which is alloyed with metalloid elements and refractory metals. The compositions can be designed using theoretical calculations of the liquidus temperature to have substantial amounts of refractory metals, while still maintaining a depressed liquidus temperature. The alloying elements are molybdenum, tungsten, chromium, boron, and carbon may be used. Some of the resulting alloys are ferromagnetic at room temperature, while others are non-ferromagnetic. These amorphous alloys have increased specific strengths and corrosion resistance compared to conventional high strength steels.

2 Claims, 33 Drawing Sheets

(51) Int. Cl.

| | |
|---|---|
| ***C22C 1/00*** | (2006.01) |
| ***C22C 1/04*** | (2006.01) |
| ***C22C 33/02*** | (2006.01) |
| ***C22C 45/00*** | (2006.01) |
| ***C22C 45/10*** | (2006.01) |
| *C21D 8/02* | (2006.01) |

(52) U.S. Cl.

CPC ..... *C22C 33/0278* (2013.01); *C22C 33/0285* (2013.01); *C22C 45/00* (2013.01); *C22C 45/10* (2013.01); *B22F 2998/00* (2013.01); *C21D 8/0215* (2013.01); *C21D 2201/03* (2013.01); *C21D 2211/004* (2013.01); *C22C 2200/02* (2013.01)

USPC ..... 148/403; 148/330; 420/64

(56) References Cited

U.S. PATENT DOCUMENTS

| | | | | |
|---|---|---|---|---|
| 3,986,867 | A * | 10/1976 | Masumoto et al. | 148/403 |
| 4,116,682 | A | 9/1978 | Polk et al. | |
| 4,221,592 | A | 9/1980 | Ray | |
| 4,473,401 | A * | 9/1984 | Masumoto et al. | 148/403 |
| 4,668,310 | A | 5/1987 | Kudo et al. | |
| 4,822,415 | A | 4/1989 | Dorfman et al. | |
| 4,945,339 | A | 7/1990 | Yamauchi et al. | |
| 5,384,203 | A | 1/1995 | Apfel | |
| 5,735,975 | A | 4/1998 | Lin et al. | |
| 5,741,374 | A | 4/1998 | Li | |
| 5,750,273 | A | 5/1998 | Inoue et al. | |
| 6,053,989 | A | 4/2000 | Orillion et al. | |
| 6,227,985 | B1 | 5/2001 | Mizushima et al. | |
| 6,261,386 | B1 | 7/2001 | Perepezko et al. | |
| 6,559,808 | B1 | 5/2003 | Petzold et al. | |
| 6,689,234 | B2 | 2/2004 | Branagan | |
| 6,692,590 | B2 | 2/2004 | Xing et al. | |
| 7,052,561 | B2 | 5/2006 | Lu et al. | |
| 2003/0051781 | A1 | 3/2003 | Branagan | |
| 2003/0164209 | A1 * | 9/2003 | Poon et al. | 148/561 |
| 2004/0140017 | A1 | 7/2004 | Branagan | |
| 2005/0034792 | A1 | 2/2005 | Lu et al. | |
| 2006/0214975 | A1 | 9/2006 | Eguchi et al. | |
| 2007/0253856 | A1 | 11/2007 | Vecchio et al. | |

FOREIGN PATENT DOCUMENTS

| | | | |
|---|---|---|---|
| JP | 2006-264200 | A | 10/2006 |
| WO | 2005/024075 | A2 | 3/2005 |

OTHER PUBLICATIONS

Dmowski, W., et al., "Structural changes in bulk metallic glass after annealing below the glass-transition temperature," Materials Science and Engineering: A, 471(1-2):125-129, Dec. 2007.

Hawley's Condensed Chemical Dictionary, 15th edition, Richard J. Lewis, Sr. (Ed.), New York: John Wiley & Sons, Inc., entry for "composite", p. 324, (2007).

Hu, Y., et al., "Synthesis of Fe-based bulk metallic glasses with low purity materials by multi-metalloids addition," Materials Letters, 57(18):2698-2701, May 2003.

Khalifa, H., et al., "Effect of Mo—Fe substitution on glass forming ability, thermal stability, and hardness of Fe—C—B—Mo—CR—W bulk amorphous alloys," Materials Science and Engineering A: Structural Materials: Properties, Microstructures & Processing, 490(1-2):221-228, Aug. 2008.

Kim, Y. C., et al., "Glass forming ability and crystallization behavior of Ti-based amorphous alloys with high specific strength," Journal of Non-Crystalline Solids, 325(1-3):242, Sep. 2003.

Kim, Y. C., et al., "A development of Ti-based bulk metallic glass," Materials Science and Engineering: A, 375-377:127-135, Jul. 2004.

Li, W. H., et al., "Study of serrated flow and plastic deformation in metallic glasses through instrumented indentation," Intermetallics, 15(5-6):706, May 2007.

Lu, Z., et al., "Structural Amorphous Steels," Physical Review Letters, 92(24):245503(1-4), Jun. 2004.

Olofinjana, A.O., et al., "Thermal devitrification and formation of single phase nano-crystalline structure in Fe-based metallic glass alloys," Materials Processing Technology, 191(1-3):377-380, Aug. 2007.

Pang, S.J., et al., "Synthesis of Fe—Cr—Mo—C—B—P bulk metallic glasses with high corrosion resistance," Acta Materialia, 50(3)489-497, Feb. 2002.

Ponnambalam, V., et al. "Fe-based bulk metallic glasses with diameter thickness larger than one centimeter," Journal of Materials Research, 19(5):1320-1323, May 2004.

Ponnambalam, V., et al., "Synthesis of iron-based bulk metallic glasses as nonferromagnetic amorphous steel alloys," Applied Physics Letters, 83(6):1131-1133, Aug. 2003.

Soliman, A. et al., "Crystallization kinetics of melt spun Fe83B17 metallic glass," Thermochemica Acta, 413(1-2):57, Apr. 2004.

Yan, M. et al, "Cooling rate effects on the microstructure and phase formation in Zr51Cu20.7Ni12Al16.3 bulk metallic glass," Science and Technology of Advanced Materials, 7:806-811, 2006.

Zhang, T., et al, "Ti-based amorphous alloys with a large supercooled liquid region," Materials Science and Engineering: A, 304-306:771-774, May 2001.

* cited by examiner (a) (b)

AMORPHOUS ALLOY MATERIALS

CROSS-REFERENCE TO RELATED APPLICATIONS

This application is a national stage application of and claims the benefit of PCT Application No. PCT/US2008/083063, filed on Nov. 10, 2008, and published as WO 2009/062196, which claims priority to U.S. Provisional Patent Application No. 60/986,981 entitled "AMORPHOUS ALLOY MATERIALS" and filed Nov. 9, 2007. The disclosure of the prior applications is considered part of (and is incorporated by reference in) the disclosure of this application.

BACKGROUND

This application relates to compositions of amorphous metallic materials and bulk metallic glasses (BMGs).

Amorphous metallic materials made of multiple components are amorphous with a non-crystalline structure and are also known as "metallic glass" materials. Such materials are very different in structure and behavior from many metallic materials with crystalline structures. Notably, an amorphous metallic material is usually stronger than a crystalline alloy of the same or similar composition. Bulk metallic glasses are a specific type of amorphous materials or metallic glass made directly from the liquid state without any crystalline phase. Bulk metallic glasses exhibit slow critical cooling rates, e.g., less than 100 K/s, high material strength and high resistance to corrosion.

Bulk metallic glasses may be produced by various processes, e.g., rapid solidification of molten alloys at a rate that the atoms of the multiple components do not have sufficient time to align and form crystalline structures. Alloys with high amorphous formability can be cooled at slower rates and thus be made into larger volumes. The amorphous formability of an alloy can be described by its thermal characteristics. One such thermal characteristic is the reduced glass transition temperature, defined as the ratio between the glass transition temperature and the melting temperature. Another thermal characteristic of a bulk metallic glass is the supercooled liquid range, defined as the difference between the glass transition temperature and the crystallization temperature. Amorphous formability increases when the reduced glass temperature decreases, and when the supercooled liquid range increases.

Various known iron-based amorphous alloy compositions suitable for making non-bulk metallic glasses) have relatively limited amorphous formability and are used for various applications, such as transformers, sensor applications, and magnetic recording heads and devices. These and other applications have limited demands on the sizes and volumes of the amorphous alloys, which need to be produced. By contrast, bulk metallic glasses can be formulated to be fabricated at slower critical cooling rates, allowing thicker sections or more complex shapes to be formed. These Fe-based BMGs can have strength and hardness far exceeding conventional high strength materials with crystalline structures and thus can be used as structural materials in applications that demand high strength and hardness or enhanced formability.

Some iron-based bulk metallic glasses have been made using iron concentrations ranging from 50 to 70 atomic percent. Metalloid elements, such as carbon, boron, or phosphorous, have been used in combination with refractory metals to form bulk amorphous alloys. The alloys can be produced into volumes ranging from millimeter sized sheets or cylinders. A reduced glass transition temperature on the order of 0.6 and a supercooled liquid region greater than approximately 20K indicates high amorphous formability in Fe-based alloys.

SUMMARY

This application describes compositions and techniques for designing and manufacturing metallic amorphous alloys with a significantly high base-metal content and high glass formability that are suitable for forming bulk metallic glasses. For example, a composition suitable for bulk metallic glasses described in this application may include 47 to 72 atomic percent titanium alloyed with 4 to 10 atomic percent silicon, 4 to 6 atomic percent tin, and 18 to 43 percent the combination of nickel and copper. An exemplary formulation for a titanium-based metallic glass material is $Ti_{100-a-b-c-d}Ni_aCu_bSi_cSn_d$, where 'a' ranges from 15 to 35, 'b' ranges from 4 to 15, and 'c' ranges from 2 to 12 and 'd' from 4 to 10, such that the atomic percent of titanium must exceed 45 at. %. Specific examples of titanium-based metallic glass materials include:

$Ti_{60}Ni_{24}Cu_8Si_4Sn_4$, $Ti_{66}Ni_{22}Cu_4Si_4Sn_4$, $Ti_{63}Ni_{20}Cu_7Si_4Sn_6$, $Ti_{55}Ni_{27}Cu_7Si_4Sn_4$,
$Ti_{54}Ni_{30}Cu_8Si_4Sn_4$, $Ti_{49}Ni_{37}Cu_6Si_4Sn_4$, $Ti_{53}Ni_{36}Cu_3Si_4Sn_4$, $Ti_{62}Ni_{27}Cu_4Si_4Sn_4$,
$Ti_{58}Ni_{30}Cu_4Si_4Sn_4$, $Ti_{58}Ni_{27}Cu_5Si_6Sn_4$, $Ti_{69}Ni_{17}Cu_4Si_6Sn_4$, $Ti_{66}Ni_{15}Cu_9Si_4Sn_6$,
$Ti_{70}Ni_{16}Cu_2Si_6Sn_6$, $Ti_{59}Ni_{19}Cu_{14}Si_4Sn_4$, $Ti_{54}Ni_{21}Cu_{16}Si_4Sn_4$, $Ti_{50}Ni_{33}Cu_5Si_8Sn_4$,
$Ti_{47}Ni_{34}Cu_5Si_{10}Sn_4$, $Ti_{56}Ni_{25}Cu_{11}Si_4Sn_4$, $Ti_{72}Ni_{15}Cu_5Si_4Sn_4$, $Ti_{58}Ni_{21}Cu_{13}Si_4Sn_4$,
$Ti_{47}Ni_{32}Cu_7Si_{10}Sn_4$, $Ti_{48}Ni_{36}Cu_2Si_{10}Sn_4$, $Ti_{53}Ni_{26}Cu_9Si_8Sn_4$, $Ti_{58}Ni_{25}Cu_5Si_8Sn_4$,
$Ti_{48}Ni_{35}Cu_5Si_8Sn_4$, $Ti_{49}Ni_{32}Cu_7Si_8Sn_4$, $Ti_{48}Ni_{30}Cu_{10}Si_8Sn_4$, $Ti_{52}Ni_{31}Cu_5Si_8Sn_4$,
$Ti_{49}Ni_{34}Cu_5Si_8Sn_4$, $Ti_{51}Ni_{29}Cu_8Si_8Sn_4$, $Ti_{48}Ni_{32}Cu_8Si_8Sn_4$, and $Ti_{55}Ni_{28}Cu_5Si_8Sn_4$.

Bulk metallic glass materials based on the above formulation may be designed by computing the liquidus temperatures based upon the concentrations of alloying elements and optimizing the compositions. This method determines alloys with high glass formability by using theoretical phase diagram calculations of multi component alloys.

As another example, this application describes a metallic glass material that includes 51 to 68 atomic percent iron alloyed with 12 to 24 atomic percent boron, up to 8 atomic percent silicon, 2 to 18 atomic percent chromium, 6 to 10 atomic percent niobium, and up to 2 atomic percent tungsten. An exemplary formulation for a niobium-based steel glass is $Fe_{100-a-b-c-d-e}B_aSi_bCr_cNb_dW_e$, where a+b is the non-metal/metalloid concentration and is less than and equal to 24, 'a' ranges from 14 to 24, 'b' ranges from 0 to 8, 'c' from 2 to 18, 'd' from 3 to 14, and e from 0 to 2 such that the atomic percent of iron must equal or exceed 50 at. %. Specific examples of glass-steels containing niobium include:

$Fe_{53}Cr_{15}Nb_{10}B_{22}$, $Fe_{66}Cr_6Nb_6B_{22}$, $Fe_{64}Cr_6Nb_6B_{24}$, $Fe_{67}Cr_5Nb_4B_{22}W_2$.
$Fe_{64}Cr_6Nb_6B_{22}W_2$, $Fe_{65}Cr_4Nb_7B_{22}W_2$, $Fe_{65}Cr_2Nb_9B_{22}W_2$, $Fe_{51}Cr_{18}Nb_9B_{18}Si_2W_2$,
$Fe_{55}Cr_{16}Nb_7B_{16}Si_6$, $Fe_{55}Cr_{16}Nb_7B_{14}Si_8$, $Fe_{55}Cr_{16}Nb_7B_{14}Si_8$, $Fe_{56}Cr_{16}Nb_8B_{14}Si_6$,
$Fe_{54}Cr_{17}Nb_9B_{16}Si_4$, $Fe_{53}Cr_{18}Nb_9B_{12}Si_8$, $Fe_{52}Cr_{18}Nb_{10}B_{18}Si_2$, $Fe_{65}Cr_{11}Nb_4B_{14}Si_6$,
$Fe_{60}Cr_{14}Nb_6B_{14}Si_6$, $Fe_{68}Cr_4Nb_6B_{22}$, $Fe_{63}Cr_8Nb_7B_{14}Si_8$, $Fe_{65}Cr_5Nb_8B_{22}$, $Fe_{64}Cr_8Nb_6B_{22}$, and $Fe_{63}Cr_9Nb_6B_{22}$.

This application further describes a metallic glass that includes 57 to 68 atomic percent iron alloyed with 8 to 12 atomic percent carbon, 3 to 12 atomic percent boron, 8 to 15 atomic percent molybdenum, 4 to 12 atomic percent chromium, and up to 3 atomic percent tungsten. An exemplary formulation for a molybdenum-based steel glass is $Fe_{100-a-b-c-d-e}C_aB_bCr_cMo_dW_e$, where a+b is the non-metal/metalloid concentration and is less than or equal to 20, 'a' ranges from 4 to 16, 'b' ranges from 4 to 16, 'c' from 2 to 18, 'd' from 6 to 14, and e from 0 to 4 such that the atomic percent of iron must equal or exceed 57 at. %. Specific examples of glass-steels containing molybdenum include:

$Fe_{61}C_{12}B_{10}Cr_4Mo_{10}W_3$, $Fe_{68}C_{12}B_3Cr_5Mo_{10}W_2$, $Fe_{57}C_9B_{11}Mo_{15}Cr_5W_3$, $Fe_{59}C_{11}B_9Mo_{15}Cr_5W_1$, $Fe_{60}C_{11}B_9Mo_{15}Cr_5$, $Fe_{57}C_{11}B_9Mo_{12}Cr_8W_3$, $Fe_{57}C_{11}B_9Mo_8Cr_{12}W_3$, $Fe_{61}C_{12}B_9Mo_{15}Cr_5W_3$, $Fe_{62}C_8B_{12}Mo_{11}Cr_4W_3$, $Fe_{60}C_{10}B_9Mo_{14}Cr_4W_3$, $Fe_{61}C_{10}B_9Mo_{13}Cr_4W_3$, $Fe_{62}C_{10}B_9Mo_{12}Cr_4W_3$, $Fe_{63}C_{10}B_9Mo_{11}Cr_4W_3$, $Fe_{64}C_{10}B_9Mo_{10}Cr_4W_3$, $Fe_{65}C_{10}B_9Mo_9Cr_4W_3$, and $Fe_{66}C_{10}B_9Mo_8Cr_4W_3$.

A process for producing a bulk metallic glass based on a composition disclosed here is described as an example. First a mixture of alloy components including the base-metal, refractory metals and metalloids is melted into an ingot (e.g., using an arc melting process). Next, the ingot is re-melted several times to produce a homogeneous molten alloy. Then, the molten ingot is solidified by suction-casting the ingot into a copper sleeve to form a bulk amorphous material. This fabrication process can be used to make Ti-based alloys or two classes of steels containing niobium or molybdenum into amorphous samples with a minimum dimension of 0.5 mm.

This application further describes a multiphase metallic glass material based on the compositions of the Fe-based glasses containing molybdenum. Specific examples of multiphase metallic glass materials include:

$Fe_{57}C_9B_{11}Mo_{12}Cr_8W_3$, $Fe_{60}C_{10}B_9Mo_{14}Cr_4W_3$, $Fe_{61}C_{10}B_9Mo_{13}Cr_4W_3$, $Fe_{62}C_{10}B_9Mo_{12}Cr_4W_3$, $Fe_{63}C_{10}B_9Mo_{11}Cr_4W_3$, $Fe_{64}C_{10}B_9Mo_{10}Cr_4W_3$, $Fe_{65}C_{10}B_9Mo_9Cr_4W_3$, and $Fe_{66}C_{10}B_9Mo_8Cr_4W_3$.

Several processes are described to fabricate multiphase metallic glass materials. A first fabrication process takes advantage of the slow solidification kinetics of fully amorphous bulk metallic glasses. The fully amorphous bulk metallic glass is devitrified via heat treatment, to control phase nucleation and crystal size when the material is heated above the crystallization temperature. This approach can result in a crystalline phase embedded in an amorphous matrix. Different phases can be nucleated from the amorphous state.

Another fabrication process is based on controlling the solidification rate of the molten alloy such that the amorphous structure is bypassed and a fully crystalline material results in which crystal size varies based on the rate of solidification.

Yet another fabrication process starts with a glass-forming composition in powder form. A desired quantity of high temperature crystal phase (e.g., tungsten carbide, WC) powder is added to the powdered steel glass. A subsequent step includes cold isostatic pressing above the glass transition temperature, followed by liquid phase sintering. Next the liquid phase mixture is quenched to yield a partially crystalline bulk metallic glass matrix composite with WC additions.

Another approach to obtain multi-phase bulk metallic glass derived materials is a process that uses a slightly modified composition of a pre-existing bulk metallic glass such that upon quenching, the additions are quenched into the amorphous matrix of the primary bulk metallic glass composition.

These and other compositions and their properties and fabrications are described in the attached drawings, the detailed description, and the claims.

BRIEF DESCRIPTION OF THE DRAWINGS

FIG. 14(*b*) shows an X-ray pattern of an amorphous steel containing niobium.

DETAILED DESCRIPTION

Designing of bulk metallic glass compositions having multiple elements with desired material properties is technically difficult in part because the complexities of the interactions and effects of the different elements. In such a complex material, a change in any aspect of the composition, such as the quantity of one element or a substitution of one element with another element, may significantly affect the property of the final metallic glass material. Due to such complexity, many known metallic glass compositions are results of trial and error. The metallic glass compositions described in this application were designed based on a systematic approach to selection of metalloid elements and refractory metal elements in combinations with a desired base-metal. The design process involved searching for compositions with high glass formability represented by a large difference between a low glass transition temperature and a high crystallization temperature. Further, a high glass formability also implies a large difference between the liquidus temperature and the ideal solution melting temperature.

Under this approach to designing a specific bulk metallic glass, the liquidus temperatures are calculated based upon the concentrations of different alloying elements selected as the constituents of the bulk metallic glass. The compositions are then optimized based on the respective resulting liquidus temperatures. The concentrations of refractory metal elements added to the base-metal alloy can also be optimized such that the final alloy has 1) a high or maximum viscosity due to high concentrations of added refractory metals, and 2) a low or minimum liquidus temperature. The compositions are selected to achieve low liquidus temperatures and high ideal solution melting temperatures so that a candidate composition has a large difference between the liquidus temperature and the ideal solution melting temperature.

Such candidate compositions can maintain their liquidus phase over a large temperature range within which a relatively slow cooling process can be used to achieve the amorphous phase in a bulk material. Among the candidate compositions with a large difference between the liquidus temperature and the ideal solution melting temperature, compositions with a large difference between a low glass transition temperature and a high crystallization temperature are further identified and selected as candidates for the final metallic glass composition. This quantitative and systematic design approach works well in predicting the compositions of existing amorphous alloys and was used to design the compositions of the examples described below.

Figure 1:
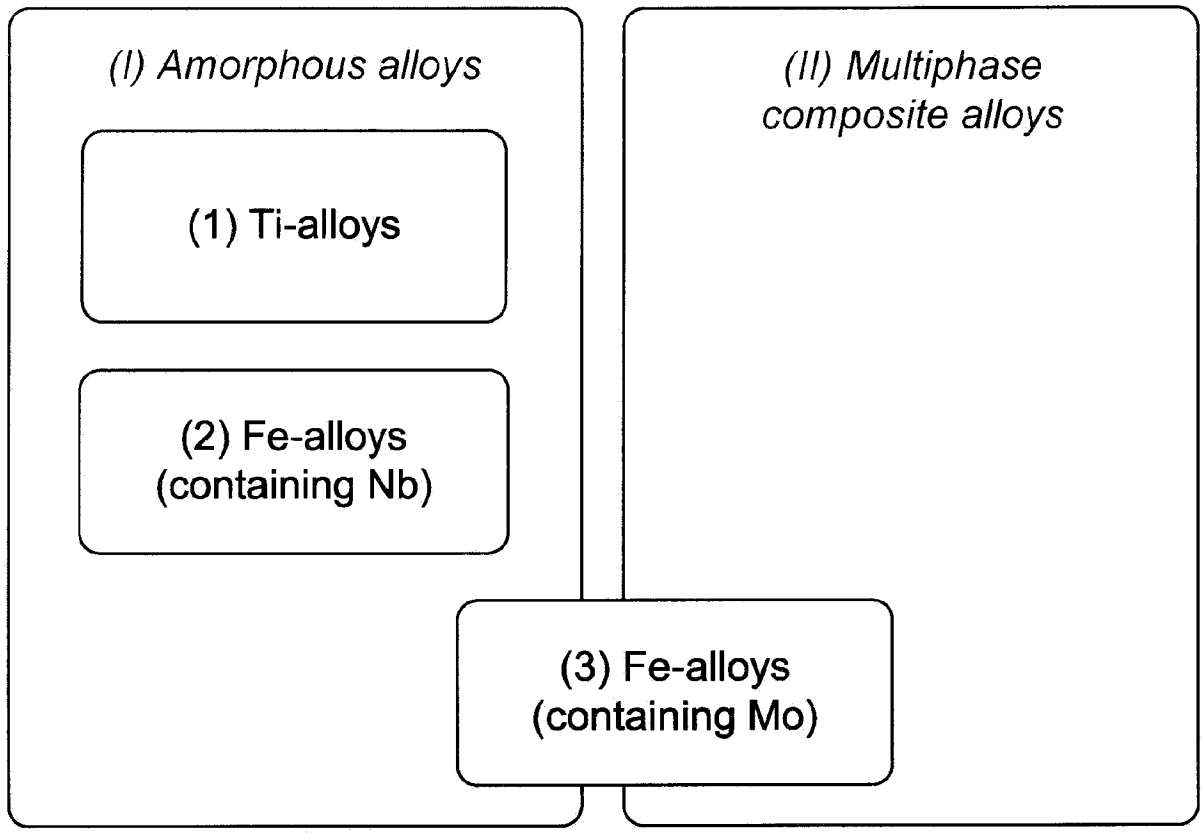
FIG. 1 shows a diagram including amorphous and multiphase composite alloys.

Applications of the above design approach are presented in this application, according to the diagram in FIG. 1. Titanium alloys belong to a first category of amorphous alloys (I). These titanium glasses contain only the relatively inexpensive alloying elements Si, Sn, Ni, and Cu. Other categories of amorphous alloys (I) in FIG. 1 are the iron alloys (2) and (3). These iron glasses, also known as amorphous steels, contain as alloying elements either Nb (category 2) or Mo (category 3).

Moreover, in the case of Fe-based alloys containing molybdenum (3), the morphology of the compound can be modified to obtain a vast array of alloys, including fully amorphous alloys, single phase partially crystalline-BMG matrix composites, multi-phase partially crystalline-BMG matrix composites, fully nanocrystalline single phase alloys, fully nanocrystalline multi-phase alloys, and fully crystalline alloys with large, complex, multi-phase microstructures. These BMG-derived multiphase composite materials (II), including the Fe-based alloys containing molybdenum (3), have very high specific strength, extremely high hardness, and good corrosion resistance compared with conventional steels, and improved plasticity compared with fully amorphous alloys (1) or (2).

EXPERIMENTAL

Most alloys discussed in this application were produced by mixing pure laboratory-grade elemental powders or granules; however when indicated, industrial-grade raw materials were used. An initial crystalline ingot was produced via arc-melting components in a zirconium gettered argon environment. Solidified alloys were remelted several times to ensure homogeneity, and the final ingot was weighed to ensure no significant weight loss had occurred during the melting process.

Figure 2A:
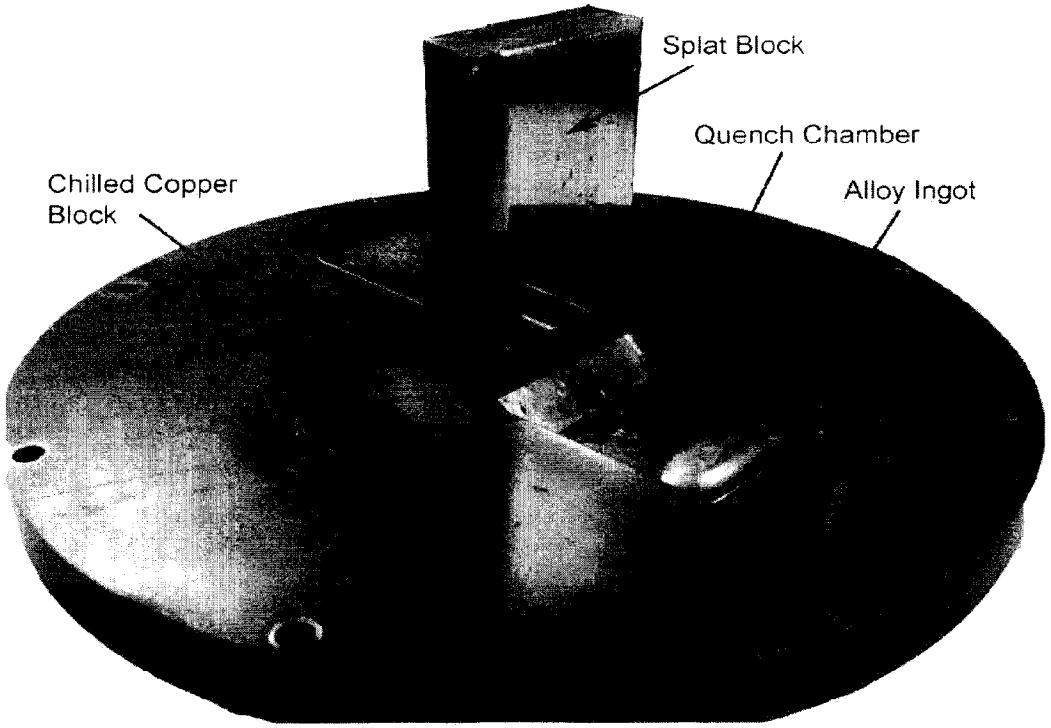
FIG. 2A shows an assembly for splat quenching alloys.

FIG. 2A shows an assembly used to produce alloys in amorphous form by a splat casting technique. The technique, carried out on a chilled copper plate, involves dropping a flat copper block on top of the molten alloy, and results in a thin sheet of about 1 mm thickness, as described below.

The alloy ingot is placed in the quench chamber as shown, and melted using the arc melter in the Zr-gettered inert atmosphere. When the alloy is completely molten, a pushrod attached to the arc-melter housing is used to tip over a splat block, which is mated to perfectly fit inside the quench chamber. When the splat block tips over and falls into the chamber the liquid alloy is spread over the entire surface area of the quench chamber, resulting in a thin sheet of about 1 mm. Contact with the surfaces of the copper splat block and the quench chamber result in the rapid quenching rate necessary to produce an amorphous solid. As can be seen in FIG. 2A, the surfaces which contact the alloy during quenching of the splat block and the quench chamber are kept in a clean polished condition. After each splat casting attempt, each surface is wiped down with a brass polishing compound and cleaned with acetone.

Despite the rapid quenching process in this technique, the entire geometry of the alloy is rarely amorphous. The bottom surface of the liquid alloy is in contact with the surface of the quench chamber during the brief period of time (~1 s), when the arc can no longer be applied to the sample and the splat block is tipping towards the alloy, but has not actually come into contact with it. Therefore, the bottom surface of the liquid alloy begins to solidify before the splat cast has taken place. The quench rate for this initial solidification is lower than that in the splat cast geometry and results in some crystallinity in this region. When analyzing the glass-forming ability, a section of the resultant sheet is broken off that does not lie in this region for analysis.

Figure 2B:
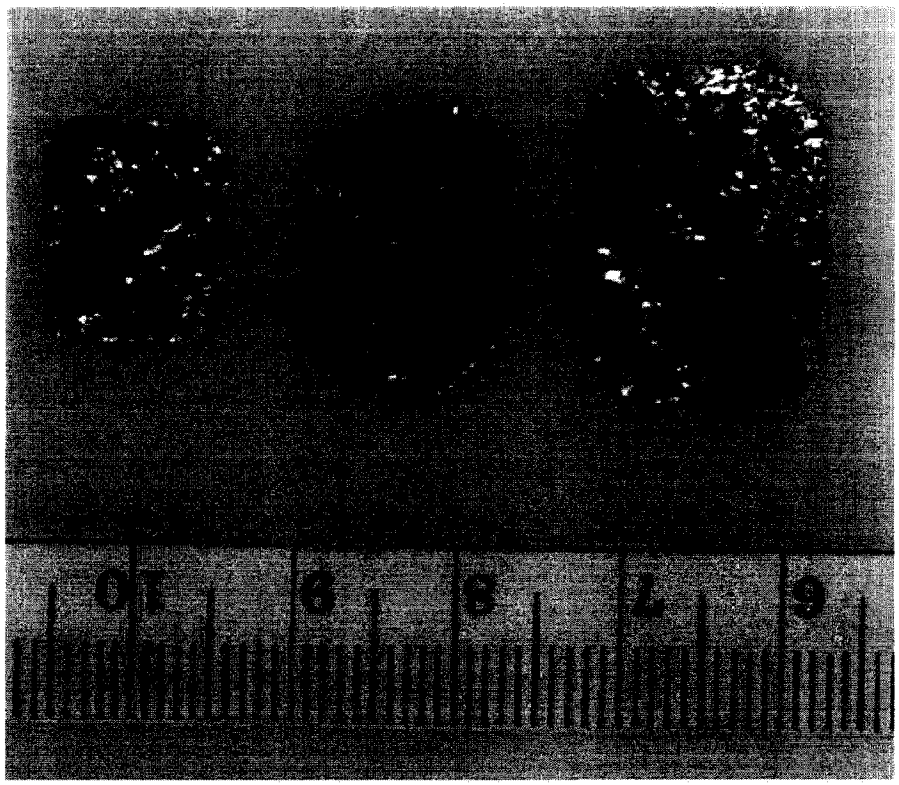
FIG. 2B shows splat cast sample geometries.

FIG. 2B shows bulk metallic glass sheets produced using the splat cast assembly in FIG. 2A. These bulk metallic glass sheets are roughly 1 mm in thickness and are completely amorphous. The thickness of the final sheet geometry can be controlled by the mass of the alloy ingot used in the process. The transverse dimension of the bulk metallic glass sheets are of order 10 mm, based on the dimensions of the quench chamber. For production of 1 mm sheets, 15-20 g alloy ingots are used, which can then be used for thermal and mechanical analysis.

The morphology of bulk metallic glass samples was then determined through physical characterization techniques. The structure of the alloys was first examined using a Rigaku X-ray diffractometer with a 20 scan range of 30 to 70 degrees.

The thermal stability of completely amorphous alloys and alloys containing minimal crystallinity was evaluated using differential scanning calorimetry (DSC) and differential thermal analysis (DTA). The glass transition temperature and crystallization temperatures were measured using a Pyris 1 Differential Scanning Calorimeter, and the liquidus temperature was measured using a Pyris Diamond Thermogravimetric/Differential Thermal Analyzer. In both DSC and DTA experiments a heating rate of 0.667 K/s was used.

The alloys which displayed the best thermal stability were used for hardness testing. The Vickers hardness was measured using a LECO micro-hardness testing machine with an indentation load of 200 grams force.

(1) Ti-Based Alloys

Examples are provided for the fabrication of an titanium-rich, low cost alloy possessing an amorphous structure, requiring only a modest cooling rate to become amorphous, thereby constituting what is referred to as a 'bulk metallic glass' material. The bulk metallic glasses described in this application contain 45 to 70 atomic percent titanium. They are further alloyed with 2 to 12 atomic percent silicon, 4 to 10 atomic percent tin, and 20 to 40 percent the combination of nickel and copper. The compositions are chosen using theoretical calculations of the glass-forming ability (GFA), which involves reducing the liquidus temperature of the alloy in addition to modeling the theoretical atomic structure of the glass. Amorphous titanium has increased specific strength as compared to conventional titanium alloys. The amorphous structure of these alloys imparts unique physical and mechanical properties to these materials, which are not obtained in their crystalline alloy forms.

Such titanium based metallic glasses can be used to produce a bulk metallic glass without the use of Zr and Be, two commonly used alloying elements which have been previously required to produce bulk metallic glass-forming alloys. These titanium glasses utilize only the relatively inexpensive alloying elements Si, Sn, Ni, and Cu. Modeling techniques discussed below allow for prediction of the precise compositions required to make a bulk metallic glass alloy from these components.

Some examples of the Ti-based compositions can be represented by the formula and conditions:

$Ti_{100-a-b-c-d}Ni_aCu_bSi_cSn_d$

The composition indexes are 'a' ranges from 15 to 35, 'b' ranges from 4 to 15, 'c' from 2 to 12 and 'd' from 4 to 10, such that the atomic percent of titanium must exceed 45 at. %. A novel approach to bulk metallic glass design is created in which the liquidus temperatures are calculated based upon the concentration of alloying elements. The compositions are optimized in a fashion detailed below.

Ti-based bulk metallic glasses presented in this application are designed in a multi-dimensional composition space using a series of modeling tools. (i) A chemical short range order model was used to evaluate the bonding behavior between the constituent species. This technique offers a prediction of the local structure present in the amorphous phase. (ii) A structural model is then used to further optimize the composition space, ensuring an efficient topology within the amorphous phase. These two models (i)-(ii) are compared with the liquidus profile. Deep eutectics correlate well with glass-forming ability, and their location and depth are located and quantified using a searching technique (iii) over a broad compositional range. Ti-based alloys were designed according to these three models (i)-(iii), and the alloys with the highest glass-forming ability represent a balance between having a densely-packed cluster structure and a close proximity to a deep eutectic.

The Ti-alloys in class (1) contain only cost-effective alloying elements, Ni, Cu, Si, and Sn. Bulk metallic glass compositions have been successfully produced over a wide compositional space using these models, and several alloys have high hardness, which increases with Si content, as shown in subsequent sections.

The techniques described are most useful for evaluating a given composition space, once the constituent elements for an alloy have been determined. For this study, constituent elements were chosen, which formed a deep binary eutectic somewhere in the Ti-rich composition space. Furthermore, solute elements were selected of various atomic sizes, to allow for an efficient topology to develop in the glassy structure. By selecting Ni, Cu, Si, and Sn, four unique topological species exist, which may occupy unique sites in the metallic glass structure. The optimized coordination number, Co. #, according to packing density of each solute element around Ti, is given in Table 1.1, along with other important thermodynamic quantities: binary mixing enthalpy ($H_{mix}$), eutectic temperature, and eutectic composition.

As shown, all the solute elements have a highly negative mixing enthalpy with Ti, which is necessary to thermodynamically stabilize the amorphous structure against crystallization. Ni forms a very deep Ti-rich eutectic, and Ti-based metallic glasses generally contain a high concentration of Ni. The Ti solvent can form three distinct cluster structures, characterized by coordination numbers of 15, 11, or 9, of solvent atoms around a particular solute.

TABLE 1.1

| Element | Co. # | $H_{mix}$ | Eutectic Temp. | Eutectic Comp. |
|---|---|---|---|---|
| Ni | 10.91 | −140 kJ | 955 | $Ti_{65.6}Ni_{24.5}$ |
| Cu | 10.83 | −67 kJ | 955 | $Ti_{57}Cu_{43}$ |
| Si | 8.88 | −211 kJ | 1330 | $Ti_{86.3}Si_{13.7}$ |
| Sn | 14.90 | −139 kJ | 1605 | $Ti_{82}Sn_{18}$ |

Figure 3:
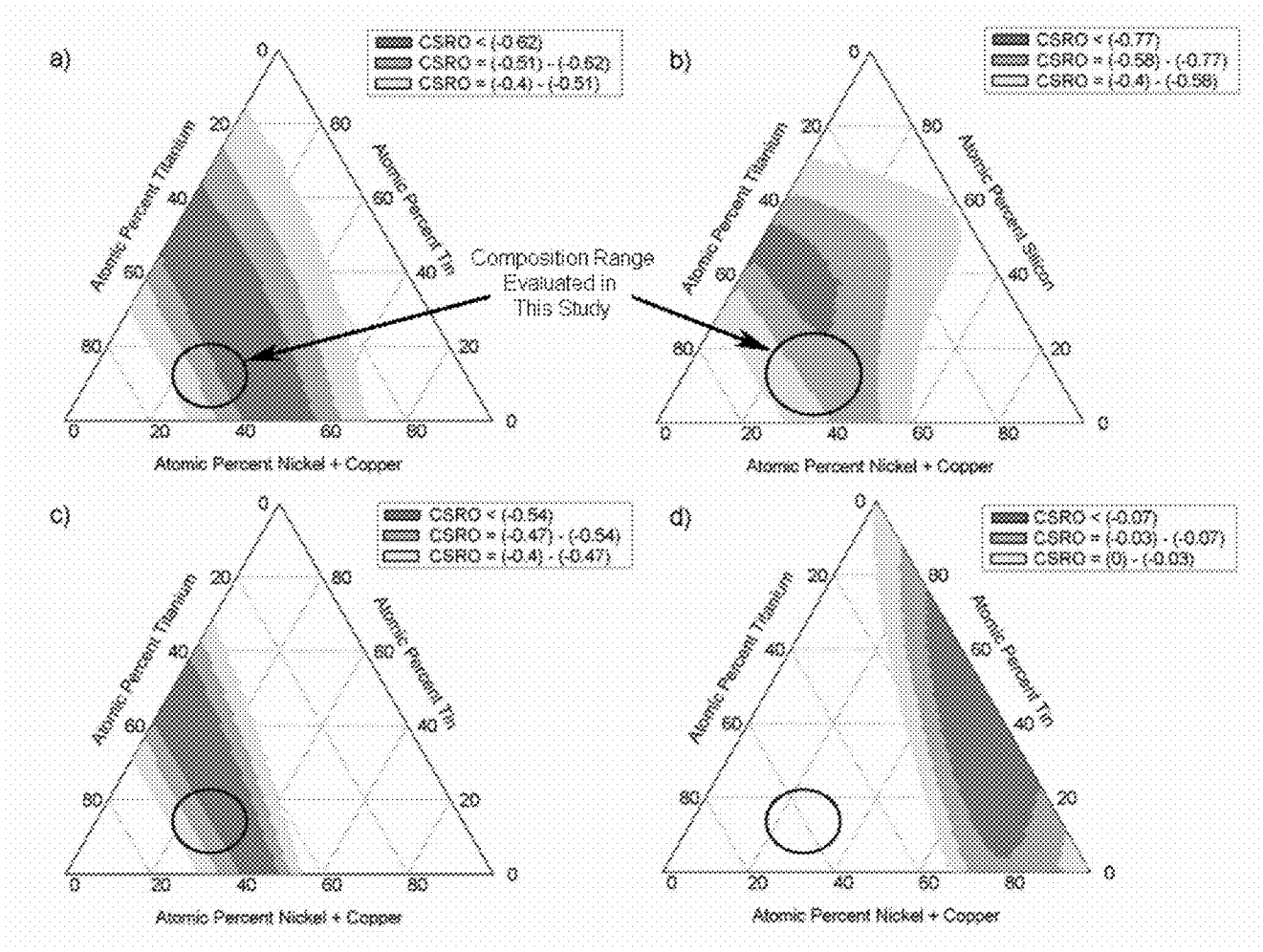
FIG. 3 shows pseudo-ternary plots including calculated chemical short range order for Ti-based alloys.

The chemical short range order (CSRO) is a measure of the local (short range) order around an element. The CSRO represents an effective potential which can be negative (indicative of order) or positive (indicative of disorder). FIGS. 3(*a*), (*b*), and (*c*) reflect the binary solvent-solute interactions between Ti—(Ni+Cu), Ti—Si, and Ti—Sn, respectively. Ni and Cu are considered as equivalent elemental species as they have similar mixing enthalpies with the other constituent elements, and are topologically equivalent. The shaded regions indicate a high chemical attraction between element pairs, with increasingly darker shades representing higher levels of attraction, defined as increasingly negative CSRO parameters. The drawn-in circles represent the general compositional range evaluated in this study.

As shown, the binary solvent-solute elemental pairs are attracted to each other (CSRO<−0.4 for the majority of compositions) in the compositional region evaluated in this study, where the Ti composition is between 40-60 atomic percent. An example of the solute-solute interactions in this alloy system is shown in FIG. 3(*d*), which shows that the (Ni+Cu)—Sn interaction is repulsive as indicated by compositions, which lie outside of the negative CSRO region. This type of repulsive solute-solute interaction occurs in the other possible solute-solute pairings, (Ni+Cu)—Si and Si—Sn. These CSRO results suggest that Ti solvent atoms will be strongly attracted to all the various solute atom types, and that solute atoms will repel each other. This type of interaction is very beneficial to the glass-forming ability, because it encourages solvent-solute clustering, and results in a densely-packed, highly-viscous liquid that effectively resists crystallization.

A parameter, alpha, is introduced as a measure of the depth of the eutectic as related to a weighted liquidus temperature. Mathematically, the parameter α is defined as $$\alpha=[\mathrm{sum}(x_i T_i)]/T_i$$

The weighted liquidus temperature is the numerator, where xi is the atomic percent of element i, Ti is the melting temperature of element i, and the summation is performed over the n elements in the alloy. In the case of good glass-forming alloys, the liquidus temperature, TI, is far below that calculated from an ideal solution. A eutectic will generate an α value greater than 1, with deeper eutectics producing larger a values.

The liquidus temperatures and corresponding α-parameters were calculated for the compositional range varying Ni from 1 to 40%, Cu from 1 to 40%, Si from 1 to 20%, and Sn from 1 to 20%, with the balance Ti. Within this compositional range, the alloy with the maximum alpha parameter is $Ti_{54}Ni_{33}Cu_7Si_4Sn_2$ with an α value of 1.27 and a theoretical melting temperature of 1434 K.

However, the low concentration of Sn prevented vitrification because it was insufficient to generate enough atomic size mismatch between the constituent elements. By elevating the Sn concentration to 4 atomic percent, a range of compositions were successfully produced with an amorphous structure. This glass-forming range is cross-plotted with the a parameter calculations as shown in the pseudo-ternary plot of FIG. 4(*a*). In this plot, the successful glass-forming compositions (circle's) and unsuccessful compositions (X's) are cross-plotted against the calculated a parameters (shaded region indicates compositions with high a parameters, where darker shades representing higher a parameters). As shown, the glass-forming alloys are clustered around the Ti—Ni rich compositions, where the deep eutectic resides as indicated by a high a parameter between 1.1 and 1.25.

Thus, the α-parameter searching technique, which was used to evaluate a compositional range, in which the four solute elements were varied, successfully determined the glass-forming range. However, this range of compositions represents the design optimization according to the α-parameter model only. It is suggested that the best glass-forming alloys will represent a compromise between both the α-parameter model and the structural model.

Using the size ratios between the constituent elements, the optimum alloy concentration can be determined using topology alone. This structural model assumes that Sn forms the primary high coordination cluster, acting as the center of a Ti solvent shell. The Ni and Cu atoms occupy the interstitial sites, and the Si atoms occupy the octahedral sites.

Using the structural model, the optimum concentration is defined by the formula $Ti_{67}(Ni,Cu)_8Sn_8Si_{24}$. However, the α-parameters for these alloys, varying Cu and Ni concentration, are between 0.85 and 0.82. Such low α-parameters suggest poor glass-forming ability. Comparing the alloys given by the formula $Ti_{67}(Ni,Cu)_8Sn_8Si_{24}$ to the location of the deep eutectics and the glass-forming compositional range shown in FIG. 4(*a*), this composition is deficient in Ni and Cu and contains an excess of Ti, Si, Sn. In order to locate an appropriate compromise between the structural and α-parameter models, the glass-forming compositions initially produced were varied compositionally in the direction of the structural models' optimum composition, $Ti_{67}(Ni,Cu)_8Sn_8Si_{24}$.

By increasing the Si content, the octahedral holes between clusters could be filled, and the packing density can be significantly increased. The Si concentration represents the most significant difference between the structural and α-parameter modeling techniques. Altering the Ti—Ni—Cu ratio drastically to favor the structural model could not be achieved without deviating enough from the eutectic composition, resulting in reduced, and eventually lack of glass-forming ability, for the resultant alloys. The Sn concentration was also altered, but did not prove to have a noticeably positive effect on glass-forming ability.

Figure 4:
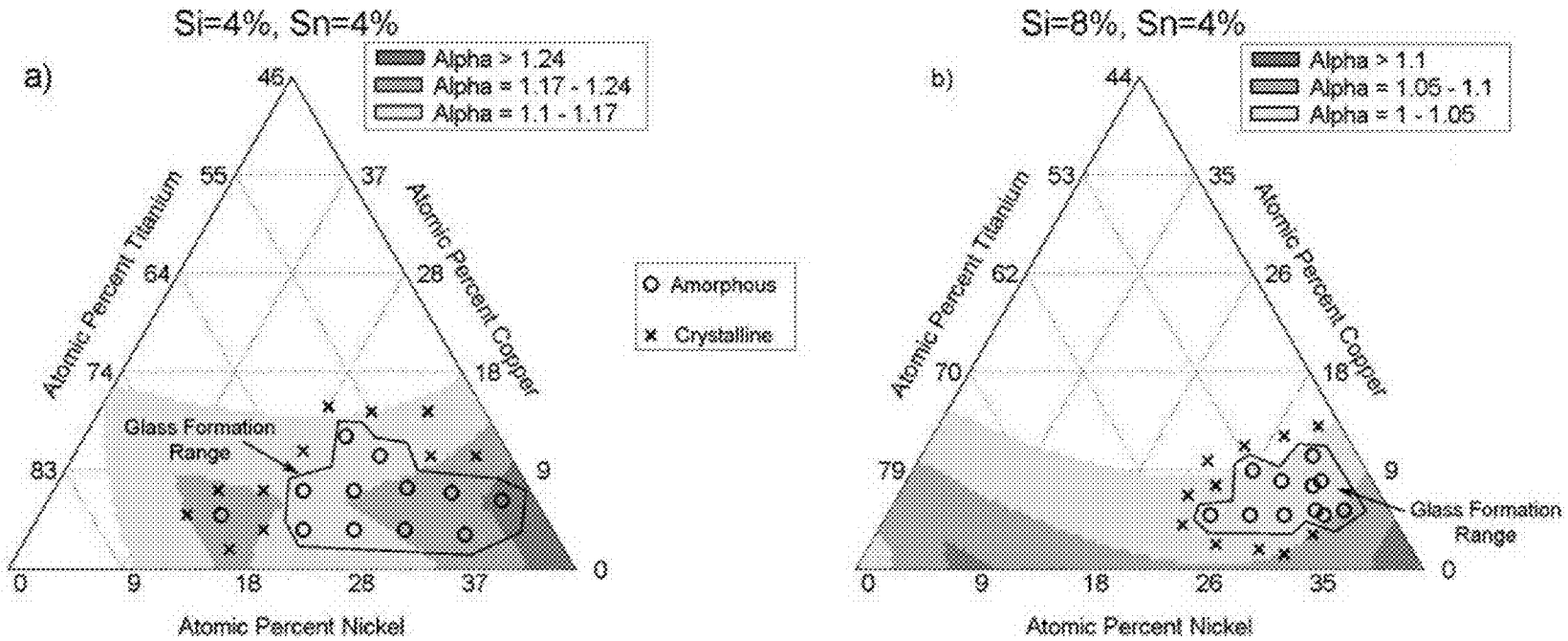
FIG. 4 shows pseudo-ternary plots including calculated α-parameter for Ti-based alloys.
Figure 5:
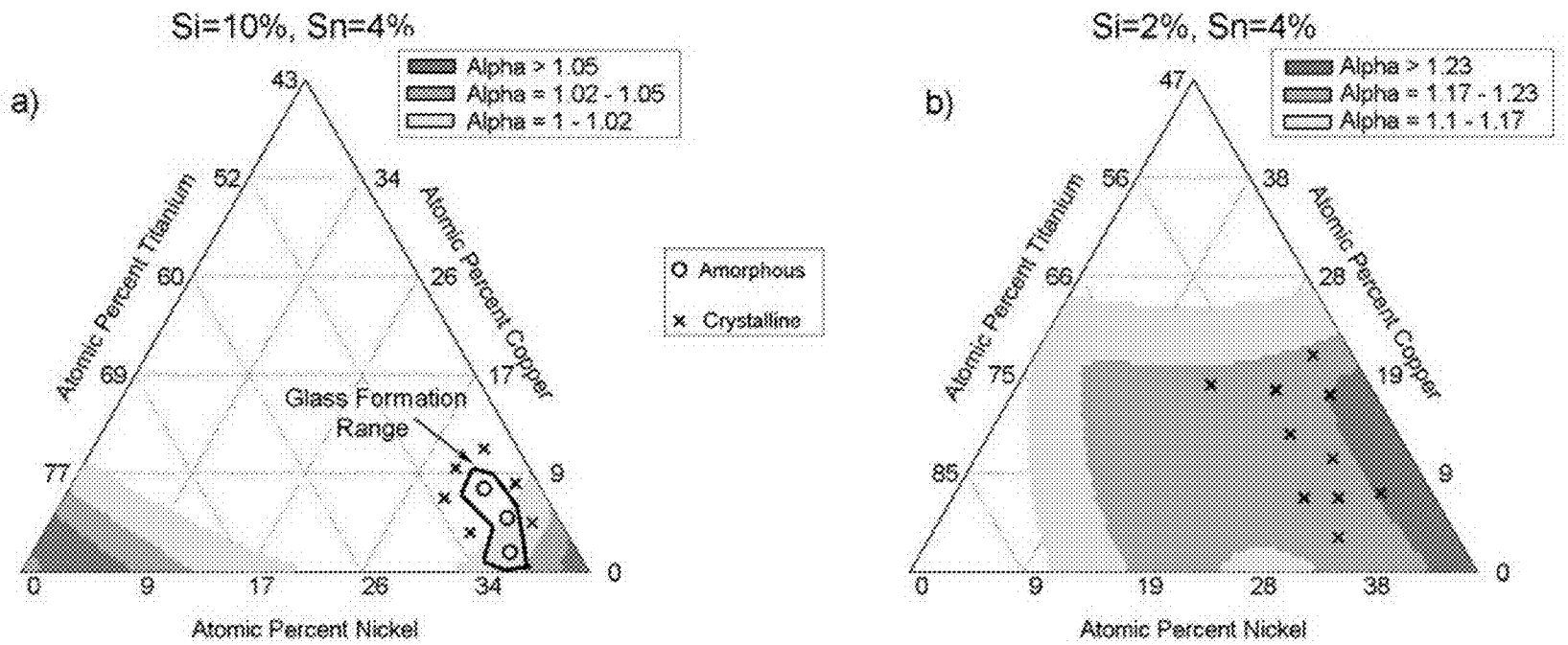
FIG. 5 shows more pseudo-ternary plots including calculated a parameter for Ti-based alloys.

Doubling the Si concentration to 8% reduces the α-parameter to just above 1 for much of the composition range. However, several compositions were produced with 8% Si, while keeping the remaining elemental concentrations at similar ratios. The glass formation region is shown in FIG. 4(*b*), and although the composition range is reduced as compared to the 4% Si alloys, several glass-forming alloys were produced. The compositional range of glass-forming alloys is reduced to the Ni-rich side, where the α-parameter is still above 1. Thus, the α-parameter profile correctly predicts the shape of the glass-forming region with increasing Si concentration. Increasing the Si concentration to 10 at. %, further reduced the area of the glass-forming composition range as indicated in FIG. 5(*a*). Each increase in the Si concentrations focused the glass formation range to Ni-rich, Cu-deficient compositions. No glass-forming alloys were successfully produced with 12 at. % Si.

FIG. 5(*b*) shows the pseudo-ternary diagram for Si=2 at. % and Sn=4 at. %. As shown, there is a broad compositional range where the α-parameter is quite high, a>1.2. However, all alloys produced with 2% Si had significant crystallinity. This highlights the importance of considering a dual approach to metallic glass design, composed of both thermodynamic and kinetic tools. While alloys containing 2% Si are in close proximity to a deep eutectic, the structural stability of the glass-forming clusters is insufficient to provide good amorphous forming ability. The best glass-forming alloys exist in the Si=4–8 at. % range, which lies between the optimal compositional space determined by the α-parameter and those determined by the structural models.

Once an atomic concentration was picked based on the design approach described above, in one implementation, such an alloy is produced by melting mixtures of good purity elements in arc furnace under an argon atmosphere. The alloy ingot is first produced in two stages. The titanium and other alloying elements are remelted several time to ensure their homogeneity. Next, the alloy is arc-melted and splat by a copper block while molten (see FIG. 2A) so that the alloy solidifies into a thin sheet between 0.5 and 1 mm (see FIG. 2B).

The following alloys were successfully produced with amorphous structures into samples at least 0.5 mm in their minimum dimension and exist within the range specified in this application:

| | | | |
|---|---|---|---|
| $Ti_{60}Ni_{24}Cu_8Si_4Sn_4$, | $Ti_{66}Ni_{22}Cu_4Si_4Sn_4$, | $Ti_{63}Ni_{20}Cu_7Si_4Sn_6$, | $Ti_{55}Ni_{27}Cu_7Si_4Sn_4$, |
| $Ti_{54}Ni_{30}Cu_8Si_4Sn_4$, | $Ti_{49}Ni_{37}Cu_6Si_4Sn_4$, | $Ti_{53}Ni_{36}Cu_3Si_4Sn_4$, | $Ti_{62}Ni_{27}Cu_4Si_4Sn_4$, |
| $Ti_{58}Ni_{30}Cu_4Si_4Sn_4$, | $Ti_{58}Ni_{27}Cu_5Si_6Sn_4$, | $Ti_{69}Ni_{17}Cu_4Si_6Sn_4$, | $Ti_{66}Ni_{15}Cu_9Si_4Sn_6$, |
| $Ti_{70}Ni_{16}Cu_2Si_6Sn_6$, | $Ti_{59}Ni_{19}Cu_{14}Si_4Sn_4$, | $Ti_{54}Ni_{21}Cu_{16}Si_4Sn_4$, | $Ti_{50}Ni_{33}Cu_5Si_8Sn_4$, |
| $Ti_{47}Ni_{34}Cu_5Si_{10}Sn_4$, | $Ti_{56}Ni_{25}Cu_{11}Si_4Sn_4$, | $Ti_{72}Ni_{15}Cu_5Si_4Sn_4$, | $Ti_{58}Ni_{21}Cu_{13}Si_4Sn_4$, |
| $Ti_{47}Ni_{32}Cu_7Si_{10}Sn_4$, | $Ti_{48}Ni_{36}Cu_2Si_{10}Sn_4$, | $Ti_{53}Ni_{26}Cu_9Si_8Sn_4$, | $Ti_{58}Ni_{25}Cu_5Si_8Sn_4$, |

-continued

| | | | |
|---|---|---|---|
| $Ti_{48}Ni_{35}Cu_5Si_8Sn_4$, | $Ti_{49}Ni_{32}Cu_7Si_8Sn_4$, | $Ti_{48}Ni_{30}Cu_{10}Si_8Sn_4$, | $Ti_{52}Ni_{31}Cu_5Si_8Sn_4$, |
| $Ti_{49}Ni_{34}Cu_5Si_8Sn_4$, | $Ti_{51}Ni_{29}Cu_8Si_8Sn_4$, | $Ti_{48}Ni_{32}Cu_8Si_8Sn_4$, | $Ti_{55}Ni_{28}Cu_5Si_8Sn_4$ |

The amorphous nature of the cast alloys was verified using X-ray diffractometry. Thermal properties are obtained using a differential thermal analyzer (DTA), a differential scanning calorimeter (DSC), and a thermal mechanical analyzer (TMA).

Figure 6:
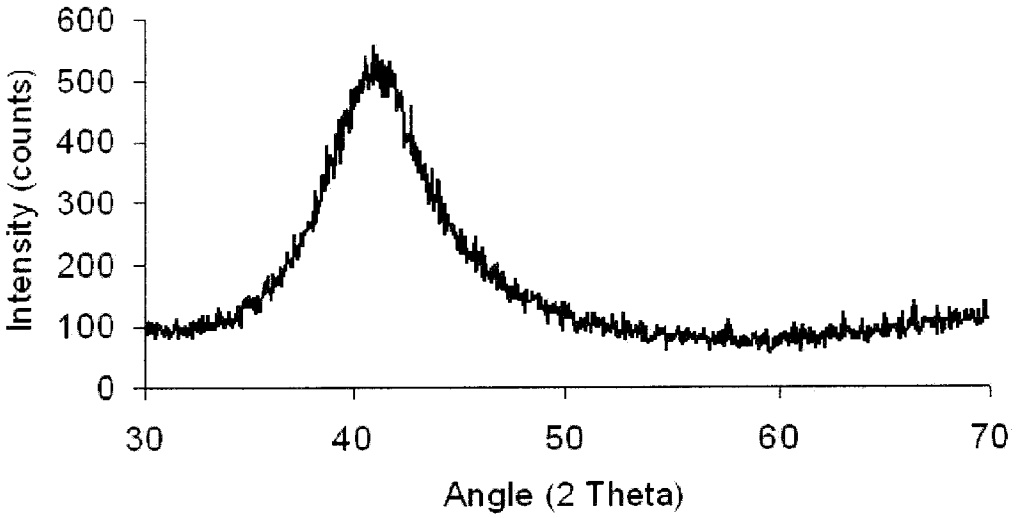
FIG. 6 shows an X-ray pattern for a Ti-based glass.

FIG. 6 shows an x-ray diffraction pattern of $Ti_{50}Ni_{33}Cu_5Si_8Sn_4$. The broad peak and lack of discrete narrow peaks signifies lack of long-range order, or amorphous structure.

Figure 7A:
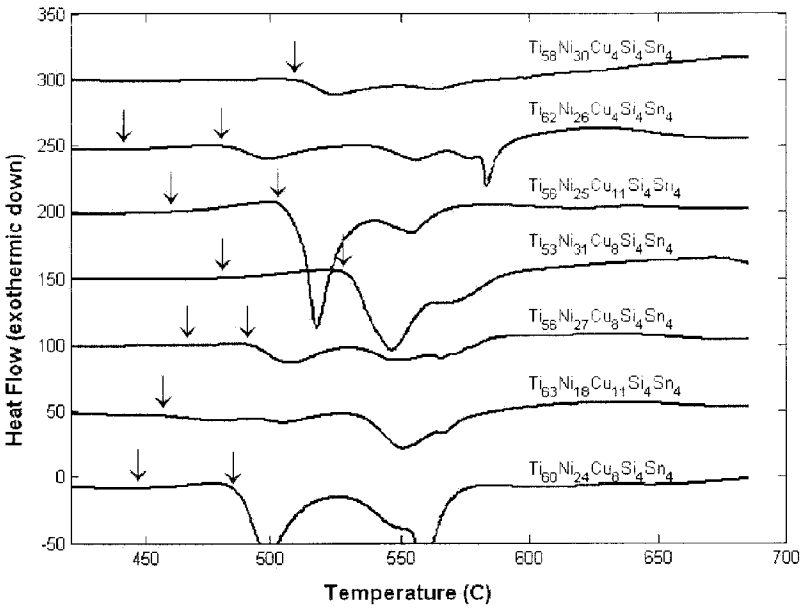
FIGS. 7A and B show differential scanning calorimetry (DSC) traces of Ti-based amorphous alloys.

FIG. 7A shows thermal analysis DSC traces, which illustrate the difference between the glass transition temperature (first arrow, at lower temperature) and crystallization temperature (second arrow, at high temperature) for several alloys containing 4 atomic % Si. The difference in the glass transition temperature (Tg) and the crystallization temperature (Tx1) was determined to be in excess of 100K, which is an indicator of good glass-forming ability.

The changes in measured heat flow at the glass transition temperature and at the crystallization temperature correspond to changes in short and long range order. There tends to be heat flow out of the material when the temperature is lowered through a phase transition where the local order increases. For example, when the material undergoes a liquid-crystal transition, heat is being released during an exothermic process. Similarly, during the glass transition, going from a liquid with low viscosity (above the glass transition temperature) to a glass with much higher viscosity, heat is again released during an exothermic process.

Figure 7B:
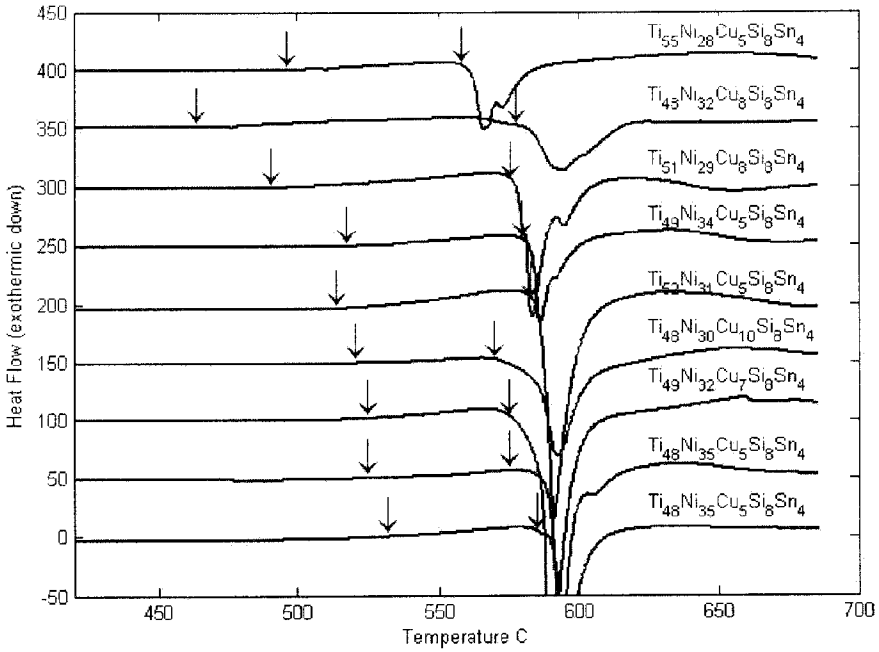
FIG. 7C shows differential thermal analysis (DTA) scans of Ti-based amorphous alloys.

FIG. 7B shows DSC traces, which illustrate the difference between the glass transition temperature (first arrow, at lower temperature) and crystallization temperature (second arrow, at high temperature) for several alloys containing 8 atomic % Si. The traces in FIG. 7B show wide supercooled liquid region widths, denoted ΔTx, for several alloys. The supercooled liquid region is defined as the difference between the crystallization temperature and the glass transition temperature, Tx−Tg. In the most extreme case, $Ti_{48}Ni_{32}Cu_8Si_8Sn_4$, has a ΔTx of 114K. This makes for a very large processing window to take advantage of the superplastic flow, which can be achieved within this temperature range.

Figure 7C:
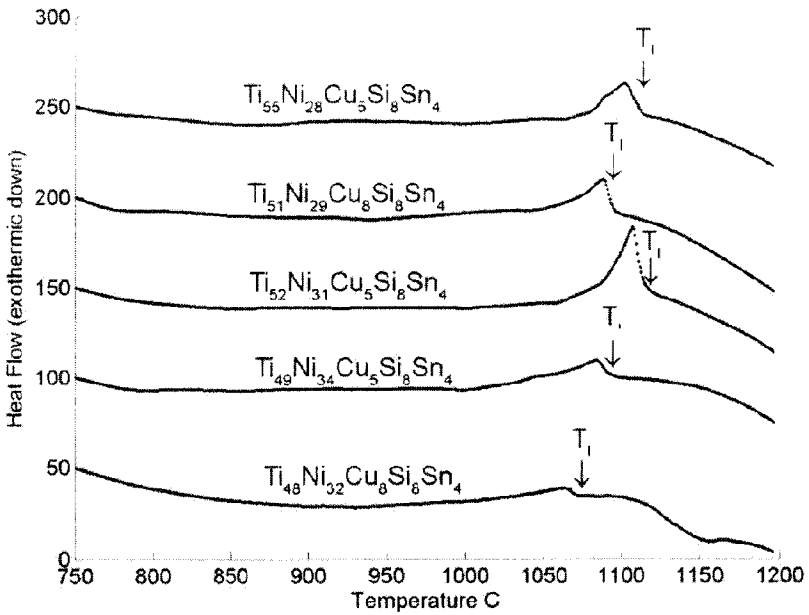

FIG. 7C shows DTA scans which correspond to some of the alloys in FIG. 7B. The liquidus temperature for each alloy is indicated by an arrow.

The complete set of thermal data for all the alloys tested in this study is listed in Table 1.2. The calculated liquidus temperature, TI (calc.), is generally higher than the actual melting temperature, TI, for every alloy, and that is expected, considering that TI (calc.) represents an equilibrium and TI is measured from a metastable material. Here the liquidus temperature is used to calculate the reduced glass transition temperature, Trg, defined as Tg/Tx, and the parameter gamma. The calculated liquidus temperatures using the liquidus model, TI (calc.), is also shown in Table 1.2.

The γ-parameter is equal to the crystallization temperature divided by the sum of the glass transition and liquidus temperature, and is dependent on both the thermal stability and viscosity of the glassy phase. As such, γ has been shown to be the most reliable parameter based on thermal measurements in predicting the maximum producible diameter, Dmax (larger γ values indicate increased glass-forming ability). The γ range for these alloys suggests that these glasses can be produced in the range of 1-7 mm; among this grouping $Ti_{48}Ni_{32}Cu_8Si_8Sn_4$ has the largest glass-forming ability with a γ value of 0.41, which indicates a Dmax of 7.1 mm.

The X-ray diffraction pattern for this alloy is shown in FIG. 6, which shows a fully amorphous structure. $Ti_{48}Ni_{32}Cu_8Si_8Sn_4$ maintains proximity to a deep eutectic, and has a sufficient amount of Si, to encourage an efficiently packed cluster structure. Any variation in Cu or Sn deviate the alloy from the eutectic composition. Decreasing the Si content reduces the packing efficiency, while increasing the Si results in a non-eutectic alloy. Thus, $Ti_{48}Ni_{32}Cu_8Si_8Sn_4$ represents a balance between topological and thermodynamic vitrification factors, and is the best glass-forming alloy amongst those evaluated in this study.

TABLE 1.2

| Alloy | $T_g$ | $T_x$ | $T_l$ | $T_l$ (calc.) | $\Delta T_x$ | $T_{rg}$ | γ | Z (calc.) |
|---|---|---|---|---|---|---|---|---|
| $Ti_{48}Ni_{32}Cu_8Si_8Sn_4$ | 738 | 852 | 1346 | 1422 | 114 | 0.55 | 0.409 | 7.1 |
| $Ti_{48}Ni_{30}Cu_{10}Si_8Sn_4$ | 795 | 844 | 1294 | 1444 | 48.8 | 0.51 | 0.404 | 5.8 |
| $Ti_{51}Ni_{29}Cu_8Si_8Sn_4$ | 765 | 850 | 1365 | 1453 | 84.8 | 0.47 | 0.399 | 4.7 |
| $Ti_{49}Ni_{34}Cu_5Si_8Sn_4$ | 792 | 854 | 1367 | 1403 | 62 | 0.47 | 0.396 | 4.1 |
| $Ti_{48}Ni_{36}Cu_2Si_{10}Sn_4$ | 810 | 867 | 1387 | 1467 | 57.75 | 0.48 | 0.395 | 4.0 |
| $Ti_{47}Ni_{34}Cu_5Si_{10}Sn_4$ | 807 | 859 | 1371 | 1226 | 35.4 | 0.49 | 0.395 | 3.9 |
| $Ti_{48}Ni_{35}Cu_5Si_8Sn_4$ | 837 | 872 | 1375 | 1385 | 52.6 | 0.51 | 0.394 | 3.9 |
| $Ti_{52}Ni_{31}Cu_5Si_8Sn_4$ | 788 | 857 | 1386 | 1433 | 68.5 | 0.46 | 0.394 | 3.8 |
| $Ti_{47}Ni_{32}Cu_7Si_{10}Sn_4$ | 825 | 866 | 1379 | 1505 | 41.9 | 0.50 | 0.393 | 3.7 |
| $Ti_{49}Ni_{32}Cu_7Si_8Sn_4$ | 800 | 850 | 1375 | 1427 | 49.7 | 0.48 | 0.391 | 3.3 |
| $Ti_{53}Ni_{26}Cu_9Si_8Sn_4$ | 786 | 833 | 1369 | 1475 | 46.98 | 0.47 | 0.387 | 2.8 |
| $Ti_{55}Ni_{28}Cu_5Si_8Sn_4$ | 771 | 832 | 1386 | 1450 | 61.1 | 0.45 | 0.386 | 2.7 |
| $Ti_{66}Ni_{15}Cu_9Si_4Sn_6$ | 765 | 820 | 1393 | 1226 | 55.2 | 0.44 | 0.380 | 2.1 |
| $Ti_{56}Ni_{24}Cu_8Si_8Sn_4$ | 772 | 816 | 1376 | 1462 | 43.9 | 0.45 | 0.380 | 2.1 |
| $Ti_{53}Ni_{31}Cu_8Si_4Sn_4$ | 756 | 803 | 1375 | 1189 | 47.2 | 0.44 | 0.377 | 1.9 |
| $Ti_{58}Ni_{27}Cu_4Si_6Sn_4$ | 750 | 799 | 1374 | 1348 | 49.1 | 0.43 | 0.376 | 1.8 |
| $Ti_{63}Ni_{20}Cu_7Si_4Sn_6$ | 725 | 762 | 1338 | 1295 | 37.4 | 0.42 | 0.369 | 1.4 |
| $Ti_{60}Ni_{24}Cu_8Si_4Sn_4$ | 722 | 760 | 1335 | 1241 | 38.2 | 0.42 | 0.369 | 1.4 |

Table 1.3 shows the Vickers hardness values for several of the alloys produced in this study. As shown, there is a large range in hardness depending on composition. The hardness, as well as the majority of mechanical properties, is heavily dependent on the free volume within the material. As mentioned previously, the atomic packing density increases with increasing Si content, as Si occupies the octahedral sites between Ti-solute clusters. Thus, as the Si concentration is increased, the free volume associated with these octahedral sites should decrease, and the material should be harder.

Figure 8:
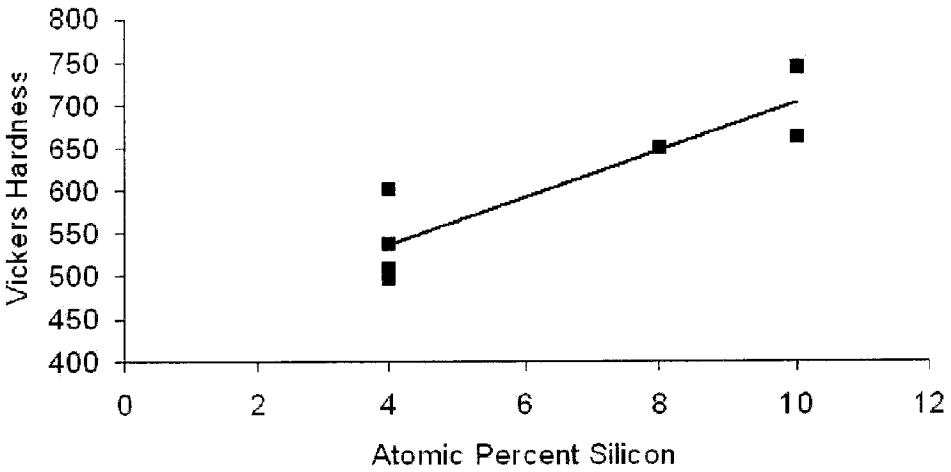
FIG. 8 shows relationship between hardness and at % Si in the Ti-based alloy.

In FIG. 8, the hardness of selected alloys is plotted against alloys' Si concentration, indicating a good correlation between increased hardness and increased Si concentration. $Ti_{47}Ni_{34}Cu_5Si_{10}Sn_4$ exhibits very high hardness, Hv=743, as a result of the elevated Si and Ni content in the alloy. However this alloy is removed for the eutectic and is thus a relatively poor glass former. Alloys containing 8% Si, have good glass-forming ability and still produce relatively hard glasses, above 650 Vicker Hardness, Hv.

TABLE 1.3

| Alloy | $H_V$ |
|---|---|
| $Ti_{60}Ni_{24}Cu_8Si_4Sn_4$ | 497 |
| $Ti_{56}Ni_{27}Cu_8Si_4Sn_4$ | 509 |
| $Ti_{66}Ni_{15}Cu_9Si_4Sn_6$ | 538 |
| $Ti_{49}Ni_{33}Cu_6Si_4Sn_4$ | 601 |
| $Ti_{48}Ni_{35}Cu_5Si_8Sn_4$ | 650 |
| $Ti_{47}Ni_{32}Cu_7Si_{10}Sn_4$ | 661 |
| $Ti_{47}Ni_{34}Cu_5Si_{10}Sn_4$ | 743 |

The comprehensive modeling criteria presented above have been used to determine a large amorphous compositional space in the Ti-rich region. Alloying elements Ni, Cu, Si, and Sn are optimal because they form eutectics in the Ti-rich regime, provide ample atomic size differences in the alloy, and are relatively inexpensive compared to many alloying elements used in metallic glasses. Several Ti-based metallic glasses were produced, which have good forming ability, calculated Dmax>5 mm, and high hardness, Hv>700.

Such Ti-based metallic glasses are characterized by high glass-forming ability, while containing cost-effective alloying elements, Ni, Cu, Si, and Sn. In addition, these alloys are not a potential health hazard like many other bulk titanium based glasses, because they lack Be as an alloying element. Ti-based metallic glasses and other materials described here can be used for a variety of applications where the relative high strength, high corrosion resistance, inherent to metallic glasses may be utilized. In addition, titanium based glasses are low density alloys and have potential for ductility in compression.

Amorphous Steels

Examples described next include a Fe-rich, low cost alloy possessing an amorphous structure, requiring only a modest cooling rate to become amorphous, thereby constituting what is referred to as a "bulk metallic glass" material. The bulk metallic glasses described in this application contain 60 to 70 atomic percent iron, and are referred to as amorphous steels. They are further alloyed with 10 to 20 atomic percent metalloid elements and 20 to 30 percent refractory metals. The compositions are chosen using theoretical liquidus temperature calculations. The alloys are designed to have substantial amounts of refractory metals, while still maintaining a depressed liquidus temperature.

The main alloying elements are niobium, molybdenum, tungsten, chromium, boron, silicon, and carbon. Some of the resulting alloys are ferromagnetic at room temperature, while others are non-ferromagnetic. These amorphous steels have increased specific strengths and corrosion resistance compared to conventional high-strength steels. The amorphous structure of these alloys imparts unique physical and mechanical properties to these materials, which are not obtained in their crystalline alloy forms. The present amorphous steel alloys can be used to form high iron content amorphous steels, with a higher Fe content than any previously demonstrated Fe-base bulk metallic glass.

Moreover, the amorphous steel alloys presented in this application do not require the use of expensive alloying elements to make the material amorphous under slow cooling conditions. Additionally, the present amorphous steels can be processed using equipment similar to equipment used in standard steel production, making them more attractive to scale up by existing steel production. Unlike the existing commercial bulk metallic glasses, which are Zr-based materials and therefore expensive to produce, the current alloy of this application is based on Fe, one of the cheapest metallic elements, making it much more competitive with existing materials.

According to the diagram in FIG. 1, two categories of amorphous steels are presented in this application: Amorphous steels containing niobium (2), which also contain Si; and amorphous steels containing molybdenum (3) which also contain C. Addition of the aforementioned additives ensures vitrification of the iron alloys (2) and (3). Both alloy categories (2) and (3) contain B, Cr, and possibly W as alloying elements.

The steel glasses in class (2) can be represented by the formula and conditions:

$$Fe_{100-a-b-d-e}B_aSi_bCr_cNb_dW_e,$$

where a+b is the non-metal/metalloid concentration and is less than or equal to 24, 'a' ranges from 14 to 24, 'b' ranges from 0 to 8, 'c' from 2 to 18, 'd' from 3 to 14, and e from 0 to 2 such that the atomic percent of iron must equal or exceed 50 at. %.

The steel glasses in class (3) can be represented by the formula and conditions:

$$Fe_{100-a-b-c-d-e}C_aB_bCr_cMo_dW_e,$$

where a+b is the non-metal/metalloid concentration and is less than or equal to 20, 'a' ranges from 4 to 16, 'b' ranges from 4 to 16, 'c' from 2 to 18, 'd' from 6 to 14, and e from 0 to 4 such that the atomic percent of iron must equal or exceed 57 at. %.

A novel approach to bulk metallic glass design is presented in which the liquidus temperatures are calculated based upon the concentration of alloying elements. The compositions are optimized in this fashion.

The steel glasses are produced by melting mixtures of high purity elements in an arc furnace under an argon atmosphere. The alloy ingots are produced in two stages. The iron and refractory elements, in the form of granules, are arc melted and re-melted several times into one homogeneous ingot. Second, the ingots are re-melted so that they are allowed to mix with elemental boron and carbon powders. The resulting ingots are then re-melted several times to insure homogeneity. Next, the alloys are arc-melted and suction-cast into a copper sleeve. Two sleeves of different thicknesses are used, 0.025" and 0.050".

The following alloys of class (2) were successfully produced with amorphous structures into samples having a minimum dimension of 0.635 mm:

| | | | |
|---|---|---|---|
| $Fe_{53}Cr_{15}Nb_{10}B_{22}$, | $Fe_{66}Cr_6Nb_6B_{22}$, | $Fe_{64}Cr_6Nb_6B_{24}$, | $Fe_{67}Cr_5Nb_4B_{22}W_2$, |
| $Fe_{64}Cr_6Nb_6B_{22}W_2$, | $Fe_{65}Cr_4Nb_7B_{22}W_2$, | $Fe_{65}Cr_2Nb_9B_{22}W_2$, | $Fe_{51}Cr_{18}Nb_9B_{18}Si_2W_2$, |
| $Fe_{55}Cr_{16}Nb_7B_{16}Si_6$, | $Fe_{55}Cr_{16}Nb_7B_{14}Si_8$, | $Fe_{55}Cr_{16}Nb_7B_{14}Si_8$, | $Fe_{56}Cr_{16}Nb_8B_{14}Si_6$ |
| $Fe_{54}Cr_{17}Nb_9B_{16}Si_4$, | $Fe_{53}Cr_{18}Nb_9B_{12}Si_8$, | $Fe_{52}Cr_{18}Nb_{10}B_{18}Si_2$, | $Fe_{65}Cr_{11}Nb_4B_{14}Si_6$, |
| $Fe_{60}Cr_{14}Nb_6B_{14}Si_6$, | $Fe_{68}Cr_4Nb_6B_{22}$, | $Fe_{63}Cr_8Nb_7B_{14}Si_8$, | $Fe_{65}Cr_5NB_8B_{22}$, |
| $Fe_{64}Cr_8Nb_6B_{22}$, | $Fe_{63}Cr_9Nb_6B_{22}$ | | |

The following alloys of class (3) were successfully produced with amorphous structures into having a minimum dimension of 0.635 mm:

| | | |
|---|---|---|
| $Fe_{61}C_{12}B_{10}Cr_4Mo_{10}W_3$, | $Fe_{68}C_{12}B_3Cr_5Mo_{10}W_2$, | $Fe_{57}C_9B_{11}Mo_{15}Cr_5W_3$, |
| $Fe_{59}C_{11}B_9Mo_{15}Cr_5W_1$, | $Fe_{60}C_{11}B_9Mo_{15}Cr_5$, | $Fe_{57}C_{11}B_9Mo_{12}Cr_8W_3$, |
| $Fe_{57}C_{11}B_9Mo_8Cr_{12}W_3$, | $Fe_{61}C_{12}B_9Mo_{15}Cr_5W_3$, | $Fe_{62}C_8B_{12}Mo_{11}Cr_4W_3$, |
| $Fe_{60}C_{10}B_9M0_{14}Cr_4W_3$, | $Fe_{61}C_{10}B_9Mo_{13}Cr_4W_3$, | $Fe_{62}C_{10}B_9Mo_{12}Cr_4W_3$, |
| $Fe_{63}C_{10}B_9Mo_{11}Cr_4W_3$, | $Fe_{64}C_{10}B_9Mo_{10}Cr_4W_3$, | $Fe_{65}C_{10}B_9Mo_9Cr_4W_3$, |
| $Fe_{66}C_{10}B_9Mo_8Cr_4W_3$. | | |

Figure 9:
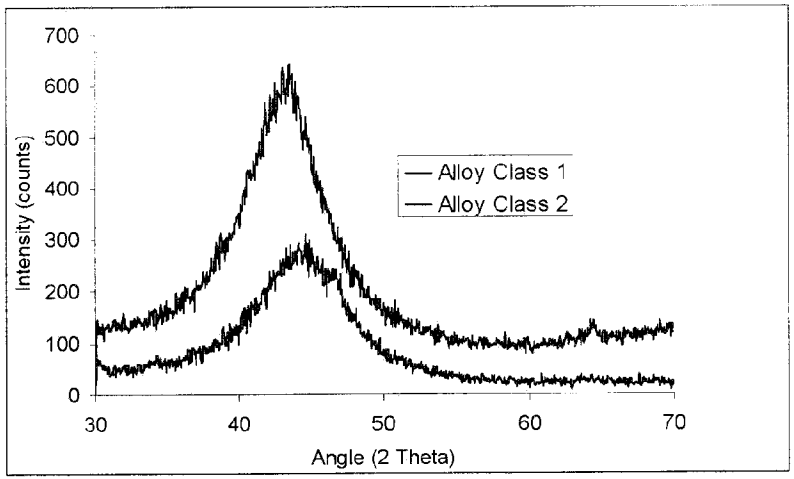
FIG. 9 shows X-ray patterns for two classes of steel glasses.

The amorphous nature of the cast alloys was verified using X-ray diffractometry. Thermal properties are obtained using a differential thermal analyzer (DTA), a differential scanning calorimeter (DSC), and a thermal mechanical analyzer (TMA). FIG. 9 contains X-ray diffraction patterns characteristic of amorphous phase for alloys from both classes of steel glasses introduced above: $Fe_{64}Cr_8Nb_6B_{22}$ in class (2), and $Fe_{57}Cr_8Mo_{12}C_{11}B_9W_3$ in class (3). A detailed characterization of the morphology and physical characterization of these classes of glass steels is presented in subsequent sections.

Compositions based on the above alloys contain higher levels of iron in combination with low cost refractory metals and metalloid elements than previously produced amorphous steels. The applications of this high iron content amorphous steel are more favorable to replace conventional high strength structural steels than any previously produced amorphous steels.

Amorphous steels in class (2) are also less expensive in terms of material cost than the alloys of class (3). By utilizing Nb instead of Mo, the material cost can be significantly reduced. Additionally, the amorphous steels in class (2) can be made without tungsten or carbon, and can contain significantly higher concentrations of Cr. Thus, in addition to being a more cost effective alloy there is a higher potential for increased corrosion resistance of the amorphous steels in class (2) due to increased Cr content.

Details on the alloy design approach and a comprehensive physical characterization is provided next for both classes of amorphous steels.

(2) Design and Characterization of Amorphous Steels Containing Niobium

A modeling tool was utilized to determine the compositional range that these inexpensive alloying elements would combine with iron to form an amorphous structure most easily. The modeling tool successfully indicated a bulk metallic glass composition and the surrounding compositional range was explored for its glass-forming ability. Experimentation revealed a wide range of potential glass-forming alloys, indicated by the large number of successful alloys produced and the formula which specifies the range as defined previously.

Figure 10:
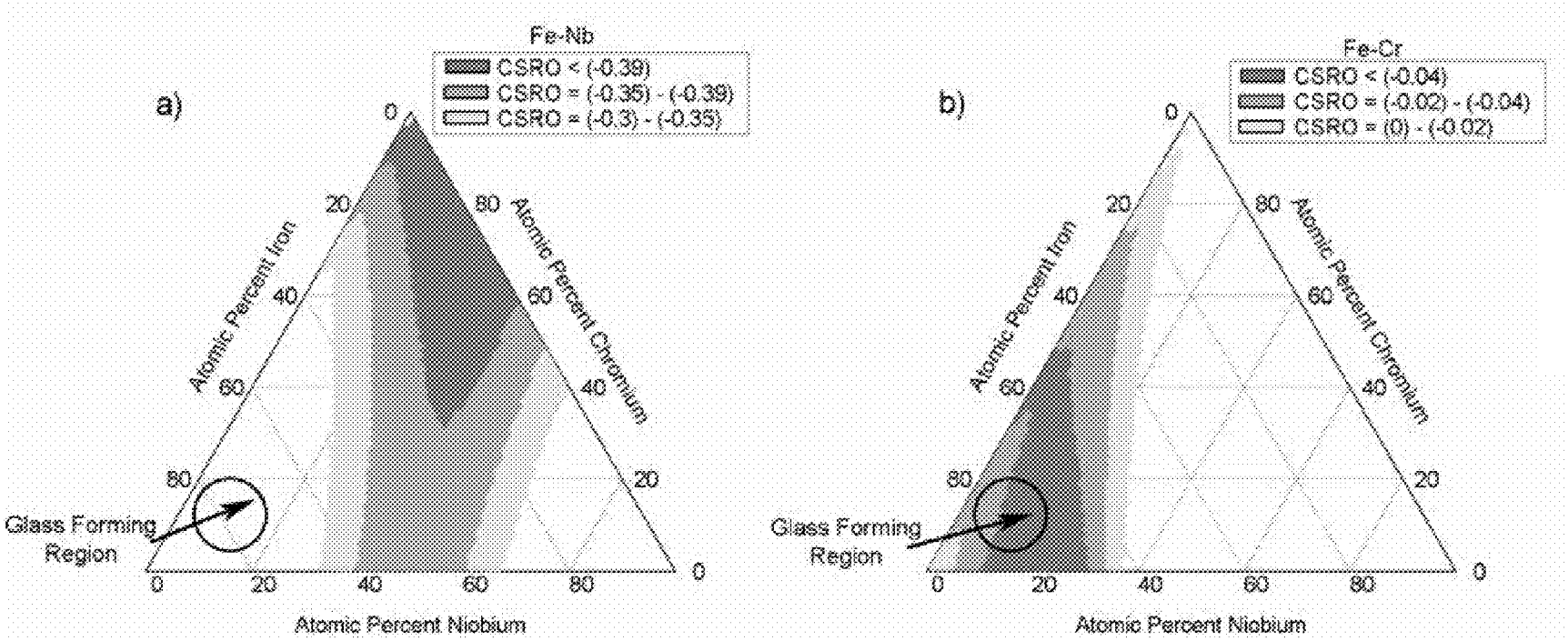
FIG. 10 shows pseudo-ternary plots including calculated chemical short range order for amorphous steels containing niobium.

The chemical short range order parameter was used to first determine the nature of interactions between dissimilar species in the liquid and glassy alloy. The interactions between the three metallic species, Fe, Nb, and Cr were evaluated in this manner. The chemical short range order (CSRO) plots are shown in FIG. 10, where the shaded regions indicate compositions where the CSRO is most negative, indicating high levels of attraction between these species. Increasingly darker shades indicate more negative CSRO parameters, and thus increasingly stronger attraction between the elemental species.

As shown in FIG. 10, the compositional region, where Fe and Nb are highly attractive, and the CSRO parameters are highly negative, is not close to the glass-forming region, which is represented by the circle in the plot. The lack of chemical attraction in the glass-forming region between Fe and Nb is critical because it suggests that these elements do not form tightly bound solvent-solute clusters with Nb acting as the center and Fe acting as the surrounding shell, a structural unit typically found in metallic glasses.

The chemical attraction between the Fe and Cr species signifies very weak levels of attraction within the glass-forming region, with CSRO parameters between 0 and −0.04 as shown in FIG. 10(*b*). The very weak attraction between dissimilar metallic species suggests that the formation of short-range order is highly dependent on metal-metalloid bonding. Since the Nb atoms are not likely to act as the center of dense clusters with Fe, their use in encouraging vitrification lies in their ability to generate elastic strain in the emerging crystalline embryo to hinder or halt nucleation. It is the use of this CSRO parameter model that allows one to make the distinction between a glass, where vitrification is governed by elastic strain, or through the production of tightly bound solvent-solute clusters. As a reference, the CSRO parameter for these Fe-based alloys is compared with the CSRO in a well studied Zr-based metallic glass $Zr_{60}Ni_{15}Al_{25}$ in Table 2.1. As shown, the solvent-solute interaction in the Fe-based glasses is much weaker as compared to the Zr-based glasses.

TABLE 2.1

| Alloy (Solvent-Solute 1-Solute 2) | Solvent-Solute 1 CSRO | Solvent-Solute 2 CSRO |
|---|---|---|
| $Fe_{60}Cr_{16}Nb_2B_{22}$ | −0.03 | −0.11 |
| $Zr_{60}Ni_{15}Al_{25}$ | −0.6 | −0.61 |

To initially determine potential glass-forming alloys, an iterative analysis of the compositional range of interest is done using the a parameter model as a selection criterion. A of this study was to produce a cost-effective alloy, the elements used in the technique were Fe, Cr, Nb, and B. The liquidus temperature and corresponding $\alpha$-parameter were computed and catalogued for every possible alloy combination within the following range: Fe from 60 to 100, Cr from 1 to 50, Nb from 1 to 50, and B from 1 to 30. The alloy that contains the highest α-parameter within this compositional range was $Fe_{60}Cr_{16}Nb_2B_{22}$ with an α value of 1.47 and a liquidus temperature of 1389 K. However, this alloy has an elastic strain value, e, of only 0.04. Thus, this alloy satisfies the α-parameter criterion, but not the elastic strain criterion, which requires ϵ054.

The most effective way to add elastic strain in these alloys is to increase the Nb concentration, as the larger Nb atom generates elastic strain in a Fe-based crystalline lattice. The elastic strain criterion for vitrification is met when the Nb content is increased to roughly 8 atomic percent, depending on the Cr concentration. Therefore, by essentially substituting Nb for Cr in the alloy, Fe-rich metallic glasses produced, which simultaneously met the elastic strain and α-parameter model criteria.

Figure 11:
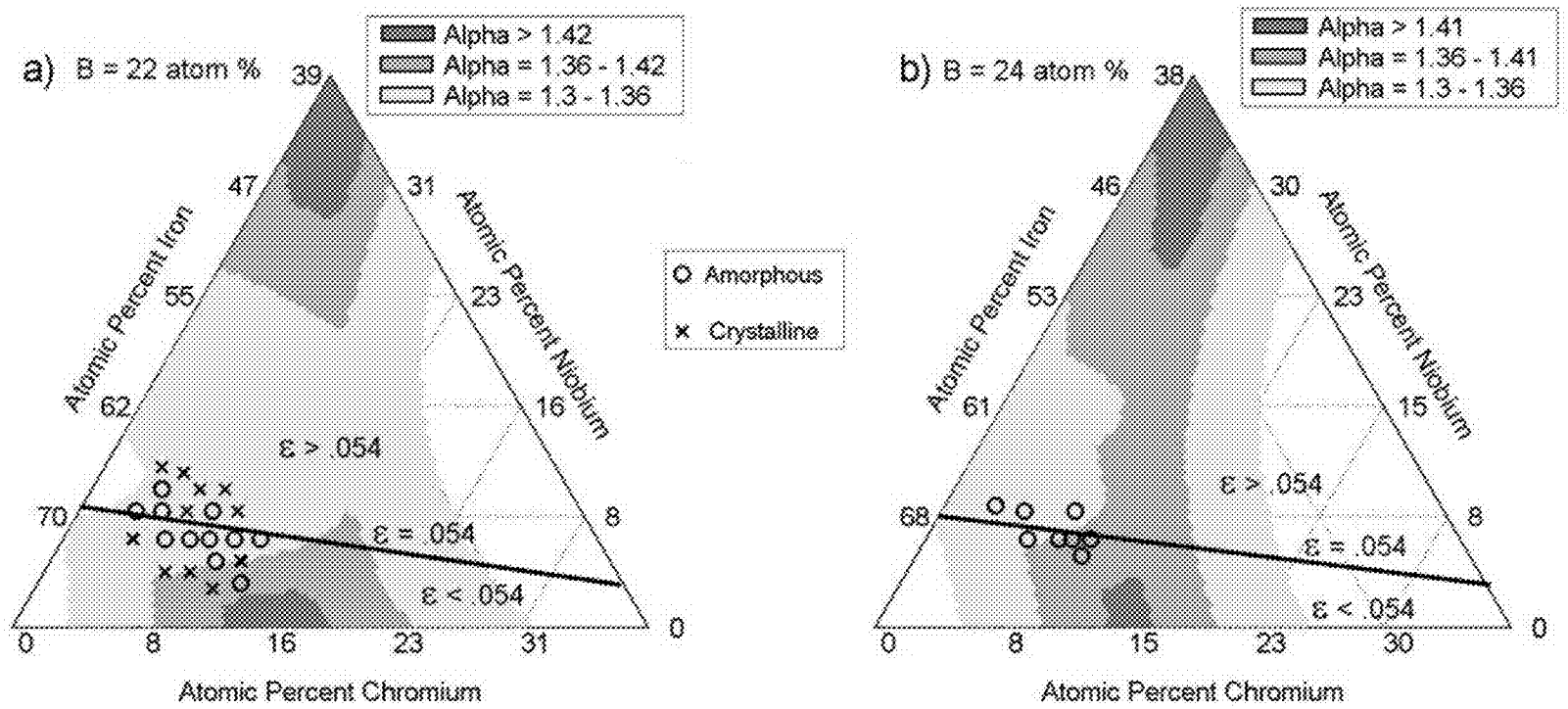
FIG. 11 shows pseudo-ternary plots including calculated α-parameter for amorphous steels containing niobium.

Two pseudo-ternary plots show the experimentally determined glass formation ranges in FIG. 11. The successful amorphous forming alloys are indicated by circles, and crystalline alloys are indicated by x's. These experimental results are cross-plotted against the α-parameter modeling results. The shaded regions indicate compositions of elevated α-parameters, with darker shades indicating increasingly higher α-parameters. The solid line indicates the minimum Nb concentration necessary to generate sufficient elastic strain. As shown in FIG. 11(*a*), the glass-forming alloys are located in close proximity to the $Fe_{60}Cr_{16}Nb_2B_{22}$ composition, but are shifted to Nb-rich compositions so that the elastic strain criterion is met.

Several alloys were successfully produced with Nb concentrations below the necessary limit to generate a sufficient amount of elastic strain. However, the best glass-forming alloy within this compositional range, $Fe_{62}Nb_8Cr_8B_{22}$, as determined using thermal analysis, met this elastic strain criterion. However, as the Nb concentration is further increased up to ~10 at. %, the composition begins to deviate significantly from the location of the deep eutectic and the glass-forming ability is reduced. FIG. 11(*a*) shows that crystalline alloys were produced using the splat casting technique, when the Nb concentration reached these elevated levels. Thus, the composition with the highest glass-forming ability represents a balance between the two effects: proximity to a deep eutectic and maximization of elastic strain. Several alloys were produced with elevated B contents, up to 26 atomic %, resulting in a slight increase in the glass-forming ability. Alloys produced in this study, containing 24 atom % B, are cross-plotted along with the theoretical calculations in FIG. 11(*b*). The glass-forming alloys are compositionally clustered around the region of sufficient elastic strain.

The thermal properties for all of the glass-forming alloys produced are listed in Table 2.2. To determine the relative glass-forming ability for these alloys, the γ-parameter was used to estimate their critical thickness, Z, using the relationship Z=2.80e−6*exp(41.70γ). The γ-parameter is equal to the crystallization temperature divided by the sum of the glass transition and liquidus temperature, and is dependent on both the thermal stability and viscosity of the glassy phase. As such, γ has been shown to be the most reliable parameter based on thermal measurements in predicting the maximum producible diameter, Dmax (larger γ values indicate increased glass-forming ability).

Figure 12A:
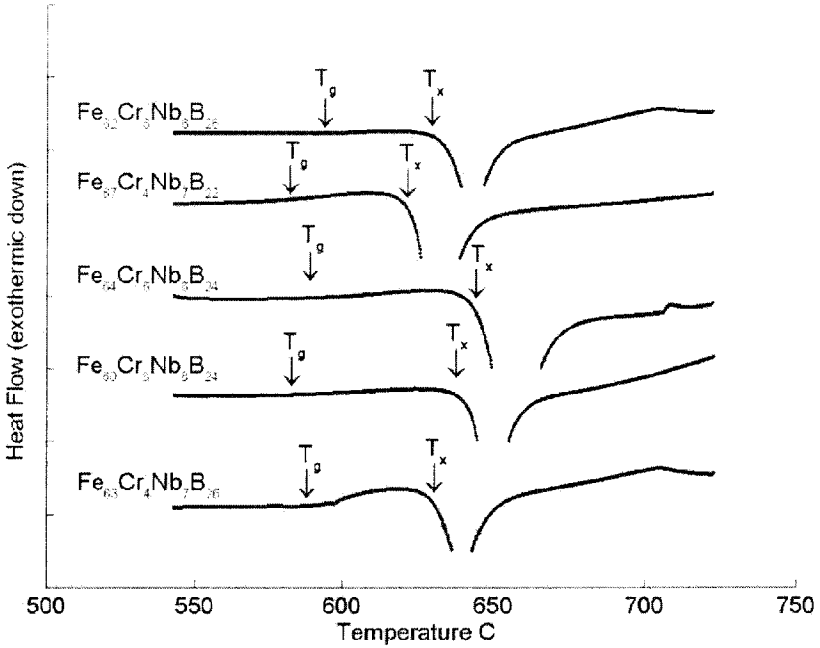
FIG. 12A shows DSC traces of amorphous steels containing niobium.
Figure 12B:
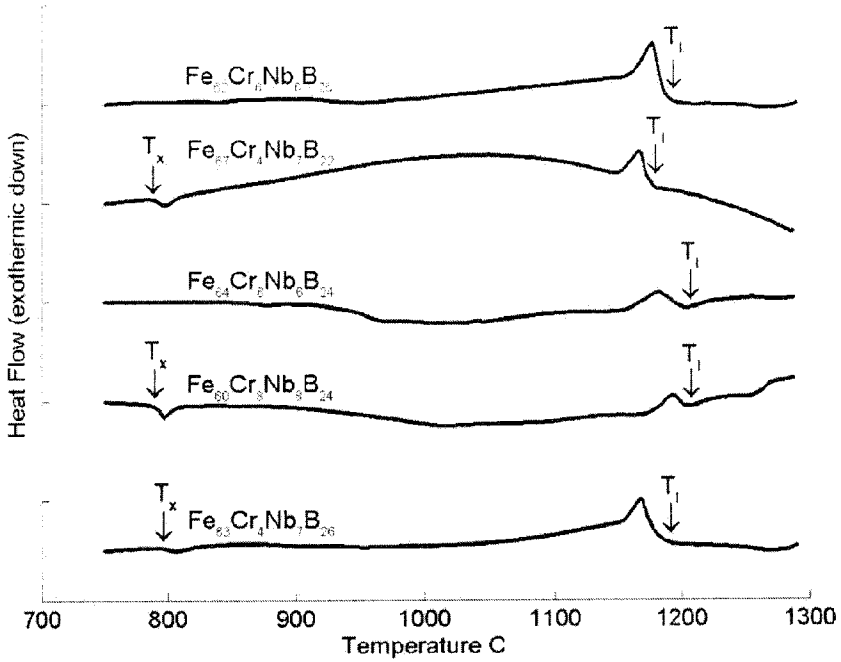
FIG. 12B shows DTA traces of amorphous steels containing niobium.

As shown in Table 2.2, the best glass-forming alloys in this study have calculated critical thicknesses ranging from 3 to 3.6 mm. The DSC scans of the five alloys with the highest glass-forming ability are plotted in FIG. 12A, and the DTA scans for these alloys are shown in FIG. 12B. Arrows are used to indicate the glass transition temperature, Tg, the crystallization temperature, Tx, and the liquidus temperature, TI. The crystallization temperatures shown in the DTA scans are secondary crystallization reactions and are not used in the calculation of thermal criteria related to glass formation in Table 2.2.

TABLE 2.2

| Alloy | $T_g$ (K) | $T_x$ (K) | $T_l$ (exp.) | $T_l$ (calc.) | $\Delta T_x$ | $T_{rg}$ | γ | Z (calc.) |
|---|---|---|---|---|---|---|---|---|
| $Fe_{63}Cr_4Nb_7B_{26}$ | 865 | 912 | 1460 | 1557 | 47 | 0.59 | 0.392 | 3.6 |
| $Fe_{60}Cr_8Nb_8B_{24}$ | 860 | 915 | 1477 | 1552 | 55 | 0.58 | 0.392 | 3.4 |
| $Fe_{64}Cr_6Nb_6B_{24}$ | 866 | 915 | 1476 | 1532 | 49 | 0.59 | 0.391 | 3.3 |
| $Fe_{67}Cr_4Nb_7B_{22}$ | 857 | 898 | 1449 | 1570 | 41 | 0.59 | 0.389 | 3.2 |
| $Fe_{62}Cr_6Nb_6B_{26}$ | 871 | 907 | 1463 | 1543 | 36 | 0.60 | 0.389 | 3.1 |
| $Fe_{64}Cr_8Nb_6B_{22}$ | 851 | 903 | 1475 | 1573 | 52 | 0.58 | 0.388 | 3.0 |
| $Fe_{63}Cr_9Nb_6B_{22}$ | 857 | 904 | 1473 | 1551 | 47 | 0.58 | 0.388 | 3.0 |
| $Fe_{61}Cr_8Nb_5B_{26}$ | 870 | 920 | 1503 | 1515 | 50 | 0.58 | 0.388 | 2.9 |
| $Fe_{66}Cr_6Nb_6B_{22}$ | 849 | 895 | 1466 | 1555 | 46 | 0.58 | 0.387 | 2.8 |
| $Fe_{61}Cr_{11}Nb_6B_{22}$ | 842 | 892 | 1477 | 1548 | 50 | 0.57 | 0.385 | 2.6 |
| $Fe_{61}Cr_{10}Nb_5B_{24}$ | 842 | 885 | 1482 | 1505 | 43 | 0.57 | 0.381 | 2.2 |
| $Fe_{63}Cr_5Nb_8B_{24}$ | 842 | 880 | 1471 | 1559 | 38 | 0.57 | 0.380 | 2.2 |
| $Fe_{65}Cr_5Nb_8B_{22}$ | 832 | 868 | 1471 | 1585 | 36 | 0.57 | 0.377 | 1.9 |
| $Fe_{60}Cr_{10}Nb_6B_{24}$ | 847 | 895 | 1531 | 1525 | 48 | 0.55 | 0.376 | 1.8 |
| $Fe_{62}Cr_8Nb_8B_{22}$ | 835 | 902 | 1563 | 1579 | 67 | 0.53 | 0.376 | 1.8 |
| $Fe_{62}Cr_8Nb_6B_{24}$ | 881 | 914 | 1559 | 1529 | 33 | 0.57 | 0.375 | 1.7 |
| $Fe_{64}Cr_3Nb_8B_{24}$ | 851 | 899 | 1550 | 1561 | 48 | 0.55 | 0.374 | 1.7 |
| $Fe_{66}Cr_4Nb_8B_{22}$ | 835 | 884 | 1559 | 1587 | 49 | 0.54 | 0.369 | 1.4 |
| $Fe_{63}Cr_{10}Nb_5B_{22}$ | 834 | 876 | 1556 | 1515 | 42 | 0.54 | 0.367 | 1.2 |

The Vickers hardness values for several of the glass-forming alloys produced in this study are listed in Table 2.3. Most of the alloys tested have Vickers hardness values between 1000 and 1200, however the $Fe_{65}Cr_5Nb_8B_{22}$ possesses an unusually high hardness of 1425±82. These hardness values are similar to those seen in other Fe-based metallic glasses, which often contain a higher concentration of relatively hard refractory elements, such as Mo (~10 atomic %).

Figure 13:
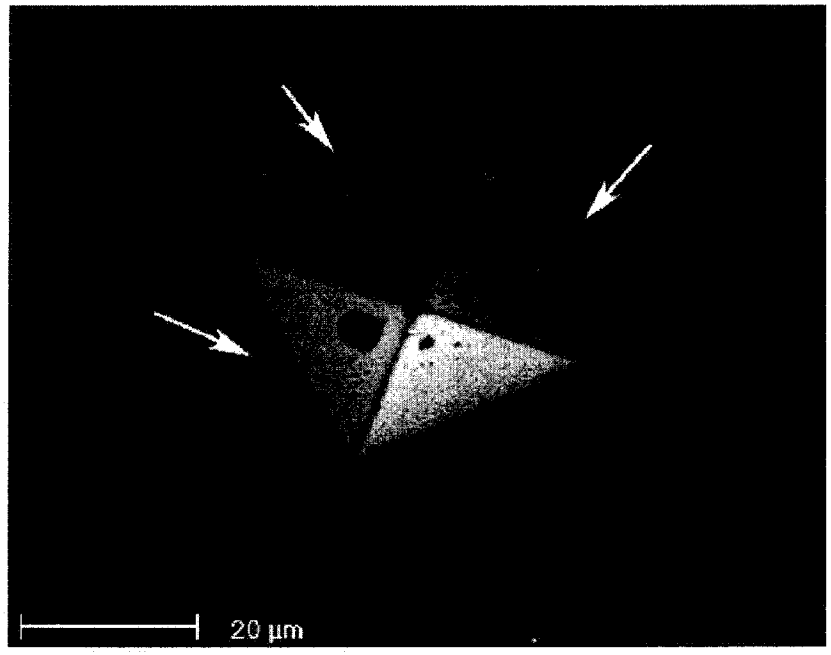
FIG. 13 shows an indentation pattern.

The SEM image in FIG. 13 shows a typical indentation pattern produced using a 1000 gram force load. The white arrows indicate shear bands, which form along the periphery of the indentation, a phenomenon which is common in metallic glass indentation experiments.

TABLE 2.3

| Alloy | $H_v$ | σ |
|---|---|---|
| $Fe_{65}Cr_5Nb_8B_{22}$ | 1425 | 82 |
| $Fe_{66}Cr_6Nb_6B_{22}$ | 1180 | 54 |
| $Fe_{64}Cr_6Nb_6B_{24}$ | 1188 | 82 |
| $Fe_{64}Cr_8Nb_6B_{22}$ | 1172 | 56 |
| $Fe_{63}Cr_9Nb_6B_{22}$ | 1171 | 89 |
| $Fe_{61}Cr_{10}Nb_5B_{24}$ | 1106 | 52 |
| $Fe_{67}Cr_4Nb_7B_{22}$ | 1088 | 72 |
| $Fe_{62}Cr_8Nb_8B_{22}$ | 1075 | 47 |
| $Fe_{63}Cr_5Nb_8B_{24}$ | 1099 | 80 |
| $Fe_{63}Cr_4Nb_7B_{26}$ | 1097 | 69 |
| $Fe_{63}Cr_{10}Nb_5B_{22}$ | 1089 | 72 |
| $Fe_{61}Cr_{11}Nb_6B_{22}$ | 1078 | 70 |
| $Fe_{64}Cr_3Nb_8B_{24}$ | 1061 | 57 |

In order to validate the use of these alloys for commercial application, industrial grade materials were used as the primary components for the alloy production. For several alloys produced in this study, it is possible to use only three stock materials for production: 430 stainless steel, industrial grade FeB powder, and laboratory grade Nb (although lower Nb purity will work as well).

Figure 14:
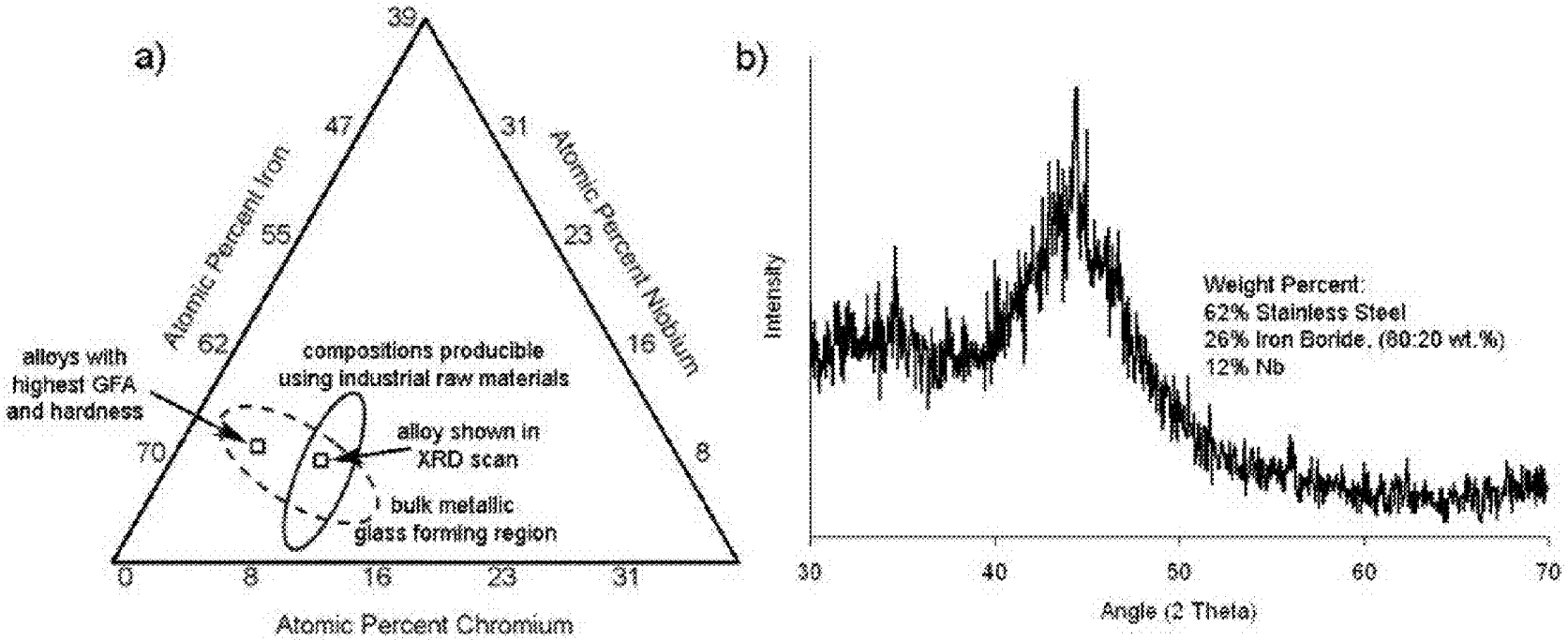
FIG. 14(*a*) shows a ternary diagram including a glass formation range for a amorphous steels containing niobium.

FIG. 14(*a*) shows the intersection between compositions, which can be created from only these three components, and the glass formation range determined in this study. As shown, the alloys with the best glass-forming ability and highest hardness do not lie within the compositional range that can be produced from only the three components described. However, the alloy $Fe_{62}Cr_8Nb_8B_{22}$ was successfully produced with an amorphous structure using the following composition in weight percent: 62% 430 stainless steel, 26% iron-boride powder, and 12% Nb. The X-ray diffraction scan for a 0.5 mm sheet of $Fe_{62}Cr_8Nb_8B_{22}$ is shown in FIG. 14(*b*).

The combinatorial modeling approach presented above has been used to design a range of steel glasses. The model can accurately assess the thermodynamic and kinetic behavior of vitrification in metals. Relative to other bulk metallic Fe-based glasses, the alloys of class (2) presented above have relatively few components and can be adapted for industrial and commercial use. It was shown that metallic glasses were composed of primarily industrial-grade materials, and do not necessitate the use of high-purity components. Thermal analysis of the alloys produced suggests that the critical thickness for these alloys is in the range of 3 mm, up to 3.6 mm for $Fe_{63}Cr_4Nb_7B_{26}$. This compound was successfully produced with an amorphous structure using primarily 430 stainless steel (62 wt %), and FeB (26 wt %), and Nb (12 wt. %).

(3) Design and Characterization of Amorphous Steels Containing Molybdenum

Design methodology and physical characterization for class (3) amorphous steels is presented in the following sections. The primary goal during the design phase was to increase the iron concentration of the bulk steel glass as high as possible, while maintaining a strong glass-forming ability. Specifically, the investigation was focused on the compositional space where boron is less than 10 atomic percent, iron is more than 55 atomic percent, and no phosphorus is present.

Figure 15:
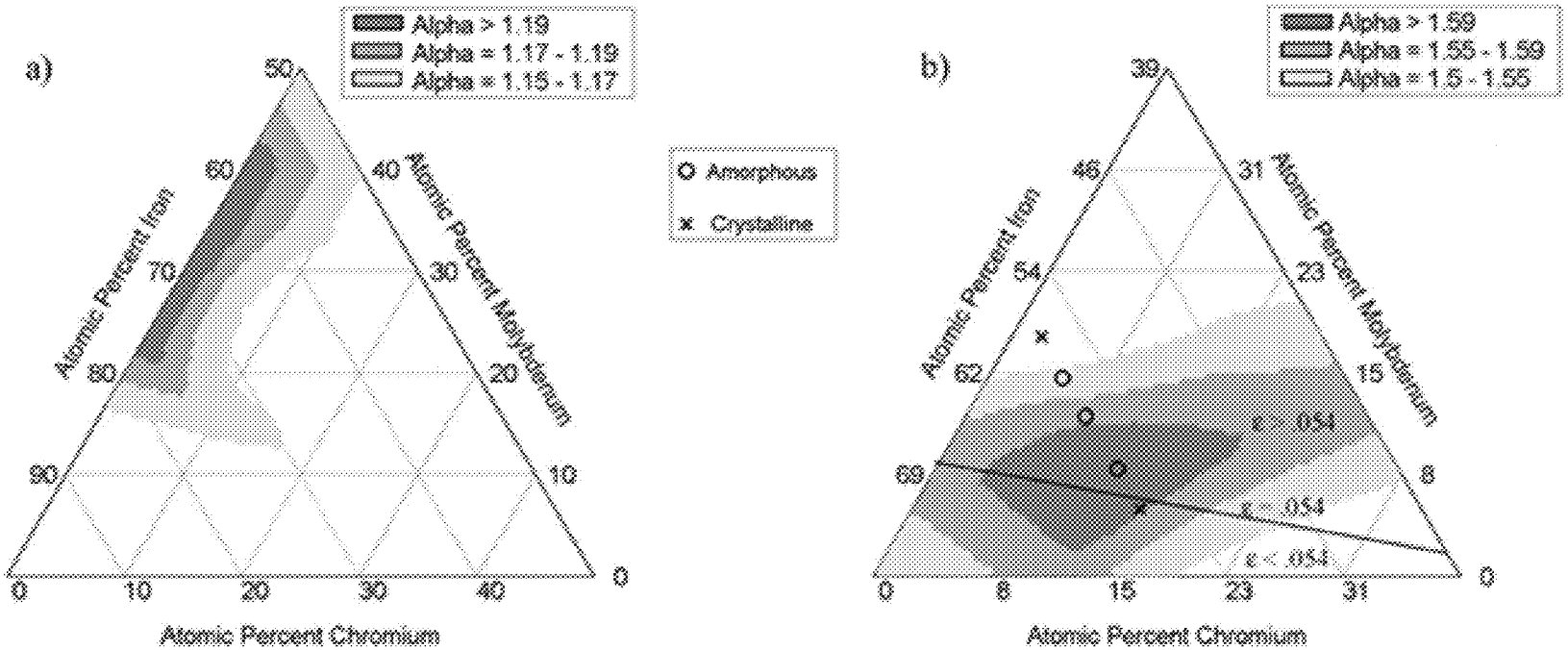
FIG. 15 shows pseudo-ternary plots including calculated α-parameter for amorphous steels containing molybdenum.
Figure 16:
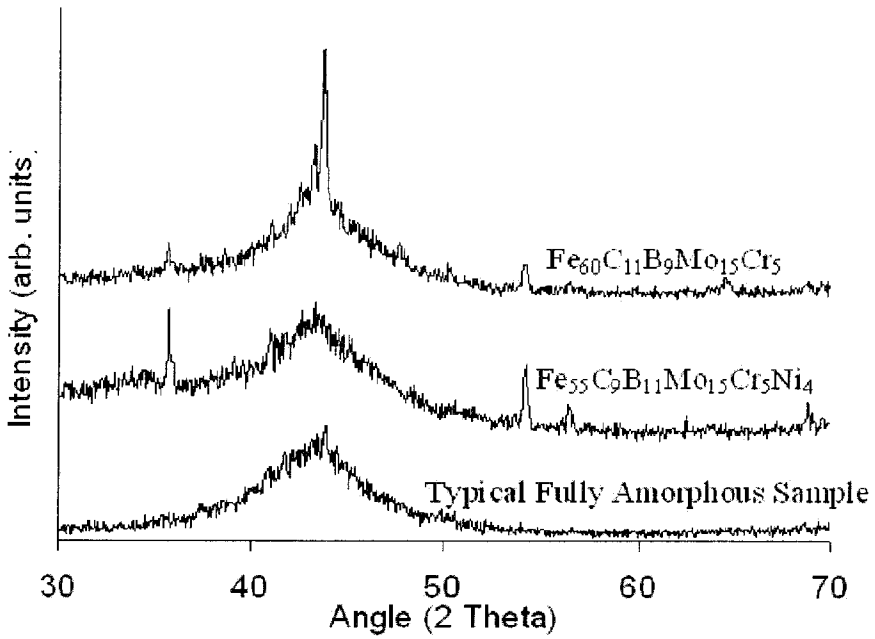
FIG. 16 shows X-ray patterns for amorphous steels containing molybdenum.

FIG. 16 shows two ternary slices from the compositional space in the Fe—Cr—Mo—C—B—W alloy system. FIG. 15(*a*) shows the α-parameter as a function of composition when carbon, boron, and tungsten are held at zero. As shown, the optimum composition lies close to the iron-molybdenum binary, at close to 60 atomic percent iron. However, as carbon, boron, and tungsten are added to the alloy, the optimum composition is shifted to a more Cr-rich composition than seen in the original ternary case, which is shown in FIG. 15(*b*). Furthermore, the maximum α-parameter in the ternary case, 1.2, is increased to 1.6 for the 6-component alloy.

The circles in FIG. 15(*b*) indicate some of the experimental compositions that were studied; filled black circles mark successfully vitrified alloys and open circles mark alloys produced with a crystalline structure. As shown, the experimentally amorphous forming range lies near the theoretical optimum a range but somewhat skewed towards more Mo-rich compositions. This is likely due to the large difference in atomic radius between molybdenum and iron as compared to that between chromium and iron, as additional molybdenum benefits vitrification according to the atomic size mismatch effect.

However, in the case of a multi-component alloy, a ternary plot is not sufficient information to determine the potential glass-forming ability of the entire compositional space. To visualize the entire compositional range in a quaternary alloy, a 3-dimensional plot, in the form of a tetrahedron, or a multitude of ternary plots are required. As the alloy further increases in component number, the ability to effectively analyze the information based upon the liquidus temperature profile alone becomes increasingly difficult. However, the α-parameter modeling is a useful method for determining eutectics in multi-component alloys and sorting them according to depth, such as in the case of amorphous steels, which are typically composed of 5-7 components.

The fabrication process presented here utilized the α-parameter sorting process to theoretically determine an optimal composition before experimental validation. Furthermore, the sorting process was subject to several constraints, which are designed to consider other phenomena that affect vitrification, as well as achieve the goals of producing a low cost material. (i) In order to ensure a significant atomic size mismatch was present in the alloy, the molybdenum content was constrained to no less than 8 atomic percent. (ii) Due to the important structural effects that boron has on the cluster formation in iron-based amorphous alloys, the atomic concentration of boron was constrained to 10 atomic percent or higher. This constraint was based upon documented experimental observations and are discussed in detail in subsequent sections. (iii) To ensure the production of a cost efficient material, the iron content was constrained to being no less than 60 atomic percent. Therefore, the compositional range computed and evaluated is given by $Fe_{60\text{-}100}Cr_{0\text{-}20}Mo_{8\text{-}20}W_{0\text{-}6}C_{0\text{-}20}B_{10\text{-}20}$.

The α parameter search criterion yielded $Fe_{62}Cr_{10}Mo_8W_2B_8C_{10}$ as the optimum alloy, and served as the starting point for experimental validation within this study. Through a minimal number of experimental trials, it was determined that additional molybdenum concentrations benefited vitrification. Two alloys similar to the one revealed theoretically were produced containing supercooled liquid regions of over 50K, $Fe_{57}C_{11}B_9Mo_{15}Cr_5W_3$ and $Fe_{62}C_8B_{12}Mo_{11}Cr_4W_3$. The compositional spectrum was further varied in a systematic way to gain further insight into the specific nature of vitrification in terms of individual components, and the α-parameter's ability to predict this effect.

The thermal parameters of all the glass-forming alloys produced in this study are listed in Table 3.1. All alloys produced contain supercooled liquid region, ΔTx, defined as (Tx−Tg), around 40K, which suggests a critical size of 2-5 mm.

TABLE 3.1

| Alloy Composition | $T_g$ | $T_x$ | $\Delta T_x$ |
|---|---|---|---|
| $Fe_{57}C_9B_{11}Mo_{15}Cr_5W_3$ | 535 | 578 | 43 |
| $Fe_{59}C_{11}B_9Mo_{15}Cr_5W_1$ | 540 | 580 | 40 |
| $Fe_{60}C_{11}B_9Mo_{15}Cr_5$ | 522 | 566 | 44 |
| $Fe_{55}C_9B_{11}Mo_{15}Cr_5Ni_2W_3$ | 560 | 599 | 39 |
| $Fe_{53}C_9B_{11}Mo_{15}Cr_5Ni_4W_3$ | — | 588 | — |
| $Fe_{57}C_{11}B_9Mo_{12}Cr_8W_3$ | 542 | 583 | 42 |
| $Fe_{57}C_{11}B_9Mo_8Cr_{12}W_3$ | 551 | 582 | 31 |
| $Fe_{61}C_{12}B_{10}Mo_{10}Cr_4W_3$ | 542 | 584 | 43 |
| $Fe_{57}C_{11}B_9Mo_{15}Cr_5W_3$ | 528 | 578 | 50 |
| $Fe_{62}C_8B_{12}Mo_{11}Cr_4W_3$ | 524 | 578 | 54 |

The X-ray diffraction results, given in FIG. 16, show typical x-ray scans for a fully amorphous sample, as well as two alloys, which have partially crystallized during the casting process. The peaks in the partially crystallized spectra correspond to several iron carbide phases. The presence of even small crystalline peaks in the otherwise largely amorphous structure was considered an indication of reduced glass-forming ability.

Figure 17:
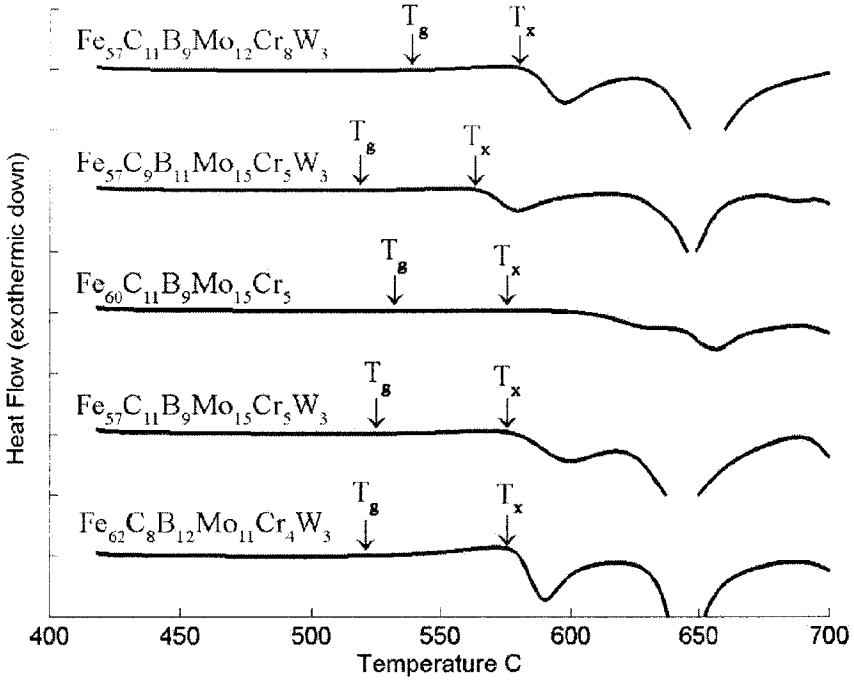
FIG. 17 shows DSC traces of amorphous steels containing molybdenum.

The DSC scans for each alloy are plotted in FIG. 17, where the glass transition temperature, Tg, and the crystallization temperature, Tx, are highlighted with arrows for each alloy.

The importance of the α-parameter in design guidance is further detailed below. Initially, the α-parameter is plotted as a function of composition in all the alloys studied, and it is generally held true that compositional regions producing high alpha parameters are better glass formers. Additional considerations include the structural effects of alloying elements that have largely varying size ratios. All signs of increased glass-forming ability have been explained according to these design predictions.

The use of boron in iron-based BMGs is common to improve vitrification. However, due to the higher cost of boron relative to carbon, it is desirable to limit boron to minimum amounts. Although both carbon and boron possess eutectic compositions in iron-based alloys, the presence of boron alone is critical to the construction of non-crystalline clusters in the liquid and super-cooled liquid state. Theoretical models predict that the iron-boron binary melts contain a different topology in the liquid state than in the crystalline state of the same composition. Iron-carbon binary alloys are more likely to form identical local topologies in both liquid and crystalline state. Thus, boron is more effective at hindering crystallization. This effect is further confirmed by the presence of iron carbide crystallization products only in the unsuccessful and partially crystallized samples. Nevertheless, carbon can be used in conjunction with boron to produce glass-forming alloys.

Figure 18:
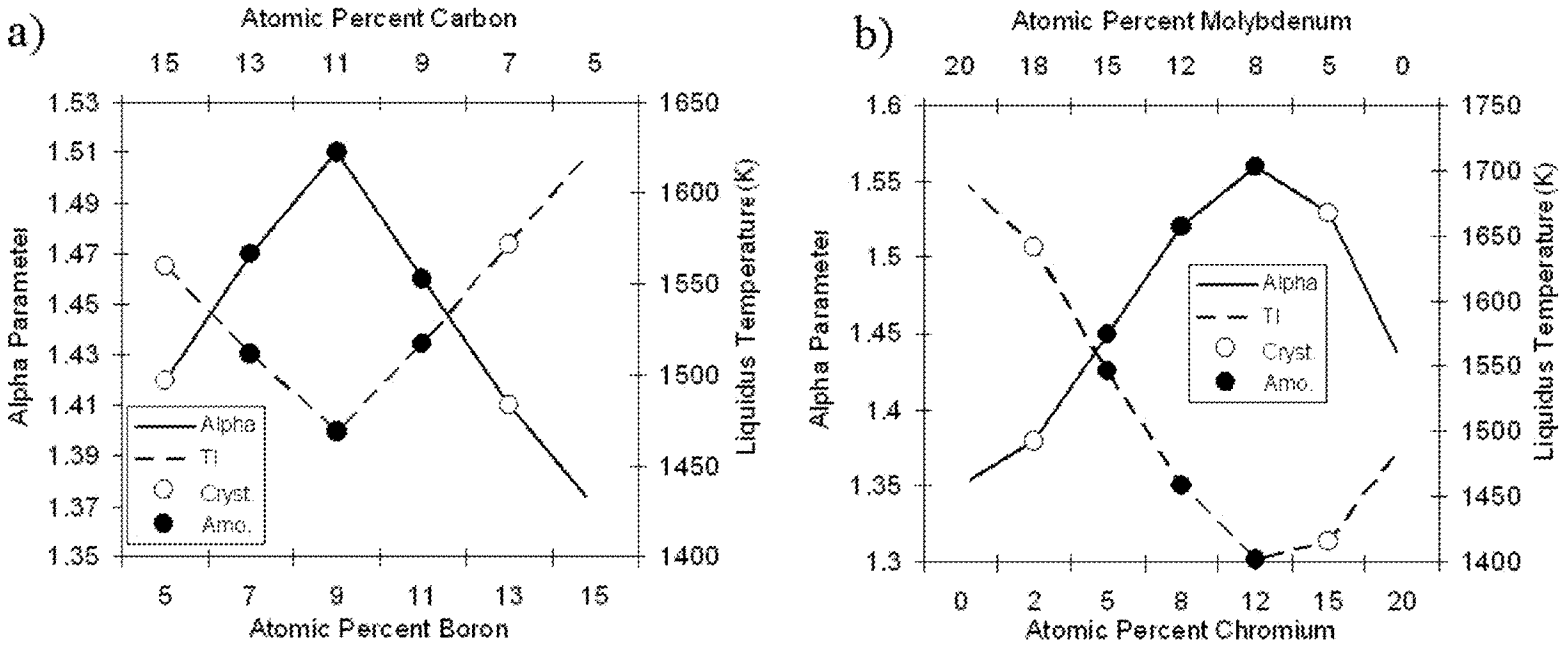
FIG. 18 shows compositional optimization of amorphous steels containing molybdenum.

FIG. 18(*a*) shows the alpha parameter and liquidus profile in a range of alloys, where only the relative carbon-boron ratios are varied. As shown, the glass-forming alloys, represented as filled black circles, have the highest α-parameter within the range studied. Attempts to produce alloys with slightly less or more boron were not amorphous, designated with open circles, highlighting the importance of the eutectic composition for determining the proper carbon-boron ratio.

A similar experiment evaluating the chromium/molybdenum ratio is presented in FIG. 18(*b*). As shown, the glass-forming region extends from the eutectic composition into the Mo-rich compositional space. Chromium is highly effective in producing deep eutectics in amorphous steels which contain carbon and boron. Therefore, the use of chromium is effective in increasing the glass-forming ability of the alloy. However, because chromium is equivalent in size to the solvent element iron, it holds no atomic size mismatch benefits. Thus, as FIG. 18(*b*) indicates, the glass-forming compositional space is skewed to the Mo-rich side. This result highlights the purely thermodynamic nature of the α-parameter. The optimum carbon-boron ratio is more accurately computed, but the atomic size difference between carbon and boron is not as significant. The ratio between chromium and molybdenum cannot be fully explained by the α-parameter, as it involves atomic packing effects critical to vitrification.

Figure 19:
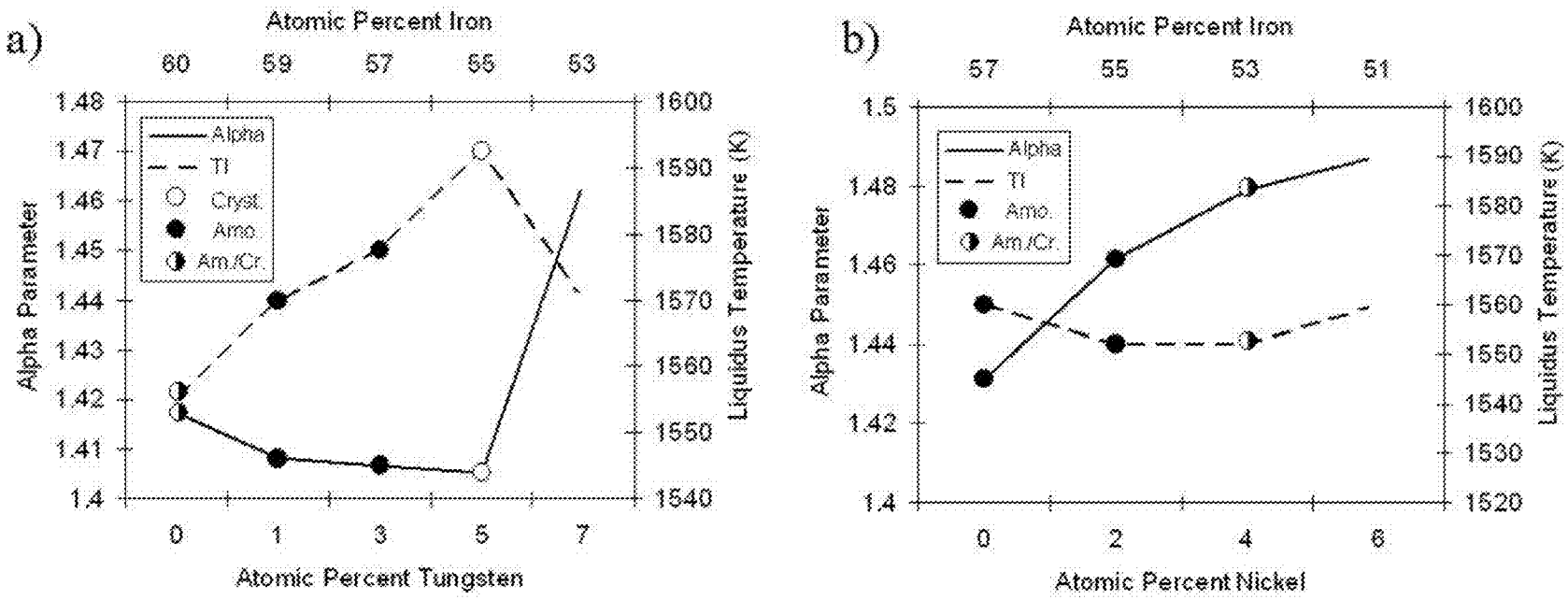
FIG. 19 shows further compositional optimization of amorphous steels containing molybdenum.

The effect of the concentration of tungsten on glass-forming ability was evaluated. The relatively large size and high melting temperature of tungsten can significantly increase the viscosity of the melt. As shown in the FIG. 19(*a*), the liquidus temperature of the alloy is slightly decreased when alloying with up to 5 atomic percent tungsten, yet this results in a significant increase in the α-parameter. In this case, the α-parameter's increase corresponds to a likely increase in the viscosity of the melt due to the addition of a refractory element, and not due to a depression in the liquidus temperature. The glass-forming ability steadily increases with an increasing tungsten concentration until 3 atomic % tungsten is reached. Further tungsten additions led to processing difficulties in our melting setup associated with un-melted W-rich phases that acted as nucleation sites during casting.

The effect of nickel addition on the glass-forming ability of amorphous steel was measured using nickel concentrations of up to 6 atomic percent. Nickel alloying does not increase the alpha parameter nor does it introduce any atomic size differences as FIG. 19(*b*) indicates. Rather, nickel may affect the topology of the alloy by occupying B-depleted zones, and more importantly forcing iron into B-rich zones. This phenomenon was suggested when short range order was found in Fe—Ni—Si—B glasses. However, the amount of nickel that was successfully alloyed to produce metallic glasses was 4 atomic percent or lower. This is likely due to, not only the increase in the α-parameter as the result of increased nickel concentration, but also to the large chemical attraction between nickel and both chromium and molybdenum.

The binary mixing enthalpies with nickel are −26 kJ and −27 kJ for chromium and molybdenum, respectively. Binary mixing enthalpies with iron are only −6 kJ and −9 kJ for chromium and molybdenum, respectively. Therefore, the potential for nickel to pull away Mo from iron rich zones is likely at increased concentrations of Ni. This would limit the ability of iron to form the dense clusters necessary for vitrification. It does appear that adding nickel increases the viscosity of the melt when used in smaller concentrations, as indicated by the large increase in the glass transition temperature measured in the $Fe_{55}C_9B_{11}Mo_{15}Cr_5Ni_2W_3$ alloy.

The Fe-based amorphous alloys in class (2) and class (3) described in the previous sections are cheaper than the Zr-based amorphous alloys and can be used in various applications: sporting goods (e.g., tennis rackets, baseball bats, and golf club heads), consumer electronics for cell phone antennas. The steel glasses of class (2) and (3) are further considered for corrosion resistant applications, non-ferromagnetic structural materials for ship-building applications (to avoid magnetic triggering of mines), for biological implants, for transformer cores, etc.

The comprehensive design tools presented above show good correlation between theoretical and experimental glass-forming compositions. Novel metallic glass compositions were designed and produced. The general classes of metallic glass materials that have been presented above are based on (1) Ti—Ni—Cu—Si—Sn, (2) Fe—Cr—Nb—B, and (3) Fe—Cr—Mo—C—B—W.

Multi-Phase Bulk Metallic Glass Derived Composite Materials

Composite nanostructured and amorphous alloys are very important for industrial applications. Investigation of crystallization behavior in steel glasses is considered below.

It was shown above that 60 to 70 atomic percent iron can be included in amorphous steels such as glasses of class (3). Amorphous steels are further alloyed with 10 to 20 atomic percent metalloid elements and 20 to 30 percent refractory metals. The principal alloying elements are molybdenum, tungsten, chromium, boron, and carbon. Some of the resulting alloys are ferromagnetic at room temperature, while others are non-ferromagnetic.

A vast array of alloys including fully amorphous alloys, single phase partially crystalline-BMG matrix composites, multi-phase partially crystalline-BMG matrix composites, fully nanocrystalline single phase alloys, fully nanocrystalline multi-phase alloys, and fully crystalline alloys with large, complex, multi-phase microstructures can be made through various processing methods.

Processing BMG-derived materials to achieve the aforementioned morphologies offers precise control over material properties. In particular, these materials have very high specific strength, extremely high hardness, and good corrosion resistance compared with conventional steels, and improved plasticity compared with fully amorphous alloys.

The amorphous steel alloys of class (3) can have higher iron content than many previously demonstrated Fe-base bulk metallic glass, without requiring use of expensive alloying elements to make the material amorphous under slow cooling conditions. The amorphous steel composition presented here can be used immediately for large scale steel production without requiring manufacturing equipment changes.

Materials studied for the remaining part of the application can be represented by the formula and conditions:

$Fe_{100-a-b-c-d-e}C_aB_bCr_cMo_dW_e$, where a+b is the non-metal/metalloid concentration and is less than or equal to 20, 'a' ranges from 4 to 16, 'b' ranges from 4 to 16, 'c' from 2 to 18, 'd' from 6 to 14, and e from 0 to 4 such that the atomic percent of iron must equal or exceed 57 at. %.

The following sections present in detail the versatility of BMG derived materials, secondary treatment of alloys in this composition space, and processing methods to achieve multi-phased microstructures. The low cost of this alloy system and its very high strength and hardness make these composite materials both novel and very useful.

Bulk metallic glasses alone have improved mechanical properties. For example, Fe-based bulk metallic glasses are known to have extremely high strength even compared to other BMG. However, Fe-based systems tend to have lower glass-forming ability. The introduction of second phase particles into a BMG matrix generates plasticity when the material is deformed.

Several approaches to fabricate multi-phase BMG-derived composite materials are presented below.

A first approach (i) is a process that utilizes the extremely slow solidification kinetics of fully amorphous BMG. The fully amorphous BMG is devitrified via heat treatment, yielding excellent control over phase nucleation and crystal size when heated above the crystallization temperature. This approach can result in a crystalline phase embedded in an amorphous matrix. Different phases can be nucleated from the amorphous state with a thorough understanding of the crystallization cascade for a given composition. More details regarding the devitrification process are presented later.

A second approach (ii) is a process through which the solidification rate of the molten alloy can be altered such that the amorphous structure is bypassed and a fully crystalline material results in which crystal size varies based on the rate of solidification. This quenching process is described in detail below.

A third approach (iii) is a multi-step method to achieve multi-phase BMG derived materials by starting with a glass-forming composition in powder form and adding tungsten carbide (WC) powder. Cold isostatic pressing above Tg followed by liquid phase sintering and subsequent quenching yields a partially crystalline-BMG matrix composite with WC additions.

A fourth approach (iv) to obtain multi-phase BMG derived materials is a process that uses a slightly modified composition of a pre-existing BMG such that upon quenching, the additions are quenched into the amorphous matrix of the primary BMG composition.

Prior to applying any of the four approaches (i)-(iv) mentioned above, it was necessary to identify crystalline phases which nucleate out of Fe-rich amorphous alloys upon devitrification. Fe-rich multi-phase BMG derived composites can be created by determining the various crystallization temperatures characteristic of each alloy and annealing at these crystallization temperatures to nucleate out different phases. X-ray diffractometry can be used to identify which phases were present.

Figure 20:
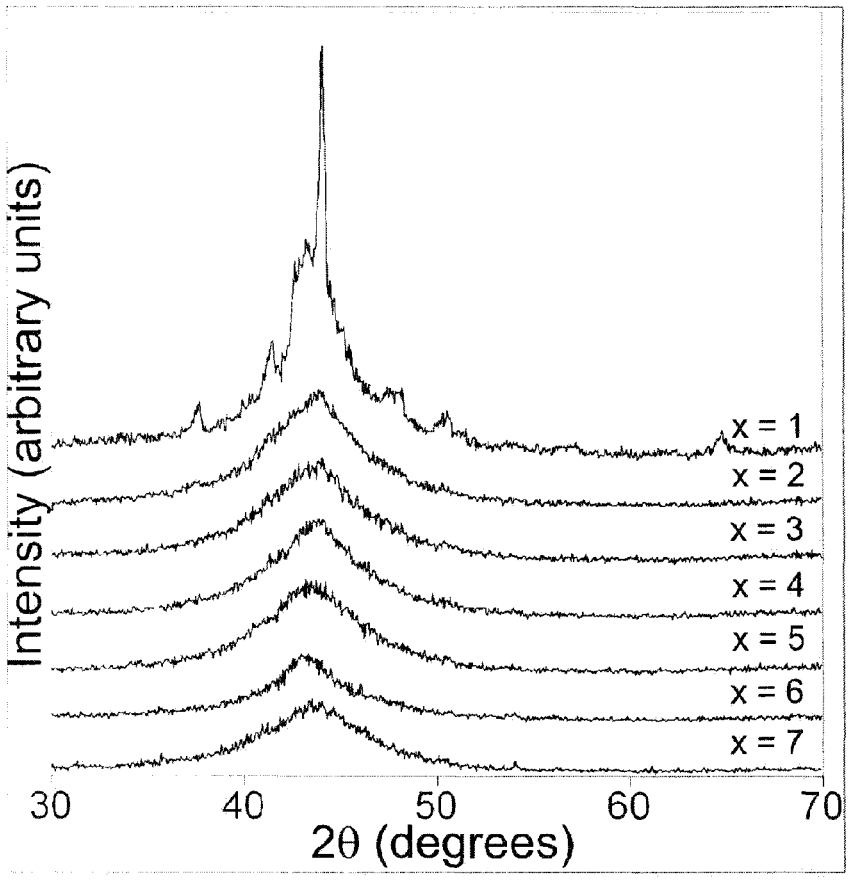
FIG. 20 shows X-ray patterns for multi-phase composite alloys.

FIG. 20 shows XRD spectra for the $Fe_{67-x}C_{10}B_9Mo_{7+x}Cr_4W_3$ (x=1-7) system. Alloys corresponding to x=2-7 in this study yielded a single, broad peak indicating a fully amorphous structure with no distinct crystalline peaks present. For x=1, crystalline peaks corresponding to the phase $Fe_{23}(C,B)_6$ are superimposed on a broad peak, indicating the presence of the crystalline phase embedded in an amorphous matrix.

Figure 21:
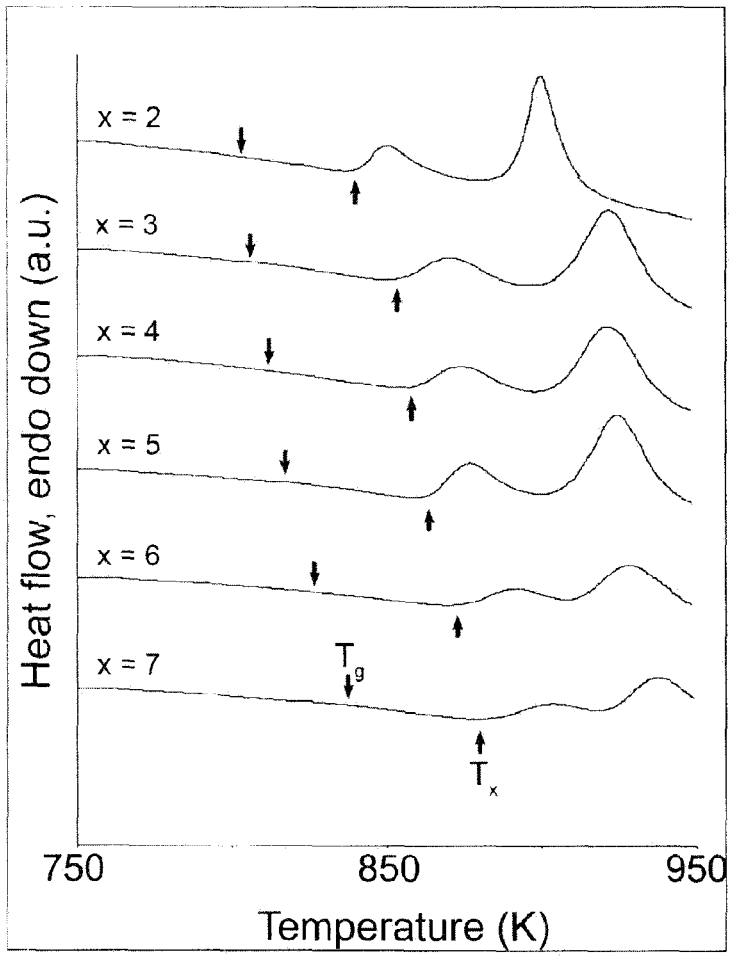
FIG. 21 shows DSC traces of multi-phase composite alloys.

The DSC curves in FIG. 21 indicate a clearly resolved glass transition for each of the 6 amorphous alloys (x=2-7). The glass transition temperature, Tg, and crystallization temperature, Tx, both decrease as the Mo content is decreased. The thermal data from the DSC scans is summarized in Table 3.2. The supercooled liquid region achieves a maximum of 51 K in the composition $Fe_{62}C_{10}B_9Mo_{12}Cr_4W_3$. Furthermore, each of the alloys in this study exhibit ΔT regions in excess of 40K. The width of the supercooled liquid region is thought to provide longer incubation time for nucleation and growth of crystalline phases, and thus is indicative of an alloy with better glass-forming ability.

TABLE 3.2

| Composition | $T_g$ (K) | $T_x$ (K) | $\Delta T_x$ (K) | $T_l$ (K) | $T_{rg}$ |
|---|---|---|---|---|---|
| $Fe_{60}C_{10}B_9Mo_{14}Cr_4W_3$ | 844 | 884 | 40 | 1385 | 0.609 |
| $Fe_{61}C_{10}B_9Mo_{13}Cr_4W_3$ | 832 | 875 | 43 | 1382 | 0.602 |
| $Fe_{62}C_{10}B_9Mo_{12}Cr_4W_3$ | 820 | 871 | 51 | 1379 | 0.595 |
| $Fe_{63}C_{10}B_9Mo_{11}Cr_4W_3$ | 818 | 862 | 44 | 1375 | 0.595 |
| $Fe_{64}C_{10}B_9Mo_{10}Cr_4W_3$ | 812 | 853 | 41 | 1372 | 0.592 |
| $Fe_{65}C_{10}B_9Mo_9Cr_4W_3$ | 808 | 848 | 40 | 1371 | 0.589 |
| $Fe_{66}C_{10}B_9Mo_8Cr_4W_3$ | — | 839 | — | 1366 | — |

Figure 22:
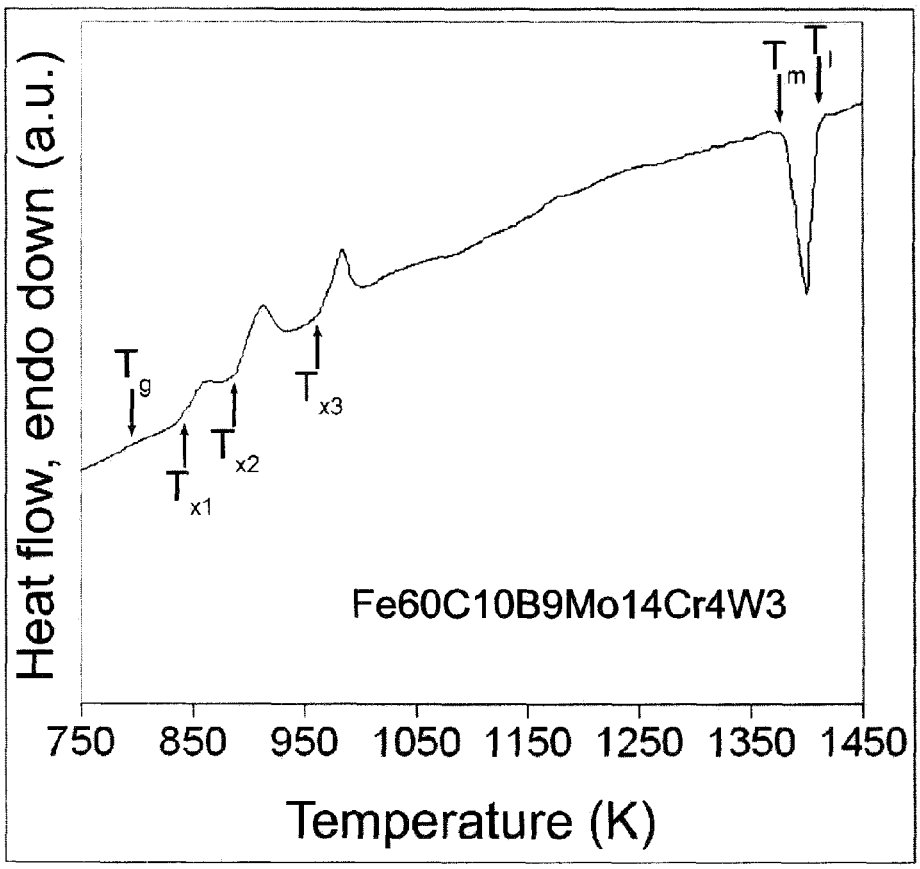
FIG. 22 shows a DTA scan of multi-phase composite alloys.

The DTA scan for $Fe_{62}C_{10}B_9Mo_{12}Cr_4W_3$ in FIG. 22 shows 3 distinct exothermic peaks at 871, 915, and 980K, respectively, corresponding to the nucleation of three separate crystalline phases upon reheating. Table 3.2 shows that the liquidus temperature decreases as the Mo content decreases. According to analyses based on the previously described alpha parameter, glass-forming ability is enhanced by suppressing the liquidus temperature. The optimum composition in this study however, occurred in the middle of the substitutional system, where the supercooled liquid region was greatest, yet had a liquidus temperature intermediate amongst the 6 amorphous alloys studied.

It is thus concluded that the ideal composition is determined by the ratio of Mo to Fe in the system necessary to create sufficient elastic strain for optimized dense random packing. The relative success of this glass-forming system is attributed to the base composition's proximity to a deep eutectic, but the optimization of the alloy at 12 at. % Mo is determined by elastic strain requirements for dense random packing.

By increasing the Mo concentration the liquidus temperature increased only marginally. $Fe_{66}C_{10}B_9Mo_8Cr_4W_3$ had a liquidus temperature of 1371 K, while $Fe_{60}C_{10}B_9Mo_{14}Cr_4W_3$ had a liquidus temperature of 1385K. The alloy with the largest supercooled liquid region in this study, $Fe_{62}C_{10}B_9Mo_{12}Cr_4W_3$, had a liquidus temperature of 1379K. From the liquidus and glass transition data, the reduced glass transition was calculated to be 0.595 for $Fe_{62}C_{10}B_9Mo_{12}Cr_4W_3$. This reduced glass transition is comparable to other documented Fe-based BMGs, and this study verifies the versatility and robustness of alloys throughout this compositional system.

As the molybdenum content is increased within the system, there is a corresponding increase in liquidus temperature. Since Tg increases more rapidly than TI as Mo content is increased, a corresponding increase in Trg is observed, which can be seen in Table 3.2. The trend in Trg does not coincide with improving glass-forming ability (GFA) as expected. The GFA optimization must therefore be governed by other factors in addition to the thermodynamics of solidification. Kinetic constraints clearly play a role in the suppression of crystal formation. This study underscores the importance of elastic strain optimization through Mo substitution for Fe. The large atomic radius of Mo atoms serves as a barrier to atomic motion, facilitating the maintenance of only short to medium range order in the alloy melt.

If, however, Mo is present in too high a concentration, there are not sufficient numbers of sites to accommodate all Mo atoms, and glassy behavior gets destabilized in favor of crystalline phases above 14 at. % Mo. If Mo content is less than the optimum value, a destabilization of the glassy state occurs at increasingly lower temperatures as Mo content is decreased. The destabilization of the glassy state is reflected by the decrease in the supercooled liquid region with decreasing Mo content. Below 9 at. % Mo, glassy behavior cannot be achieved in this system. Despite having slightly smaller supercooled liquid regions, the alloys in this study with less Mo are appealing because they have lower Tg making them processible at lower temperatures, as well as at significantly lower cost.

It was mentioned above that a first (i) fabrication process of the multi-phase BMG derived composite materials is devitrification. To characterize this fabrication process, specifically the aspects of alloy resistance to crystallization and crystalline phase evolution, various heat treatments of the fully amorphous BMG were performed. The resistance to crystallization within the supercooled liquid region was investigated by heating each alloy up to Tg+20K, Tg+30K, Tg+40K, and Tg+50K, and then holding for 10 minutes at each condition. Shaping and forming of BMGs for specific applications is done in this temperature range. The anneal time for these experiments represents more than ample time for shaping processes employed in BMGs such as thermoplastic forming (TPF), aerodynamic levitation, and conventional mold casting.

Figure 23A:
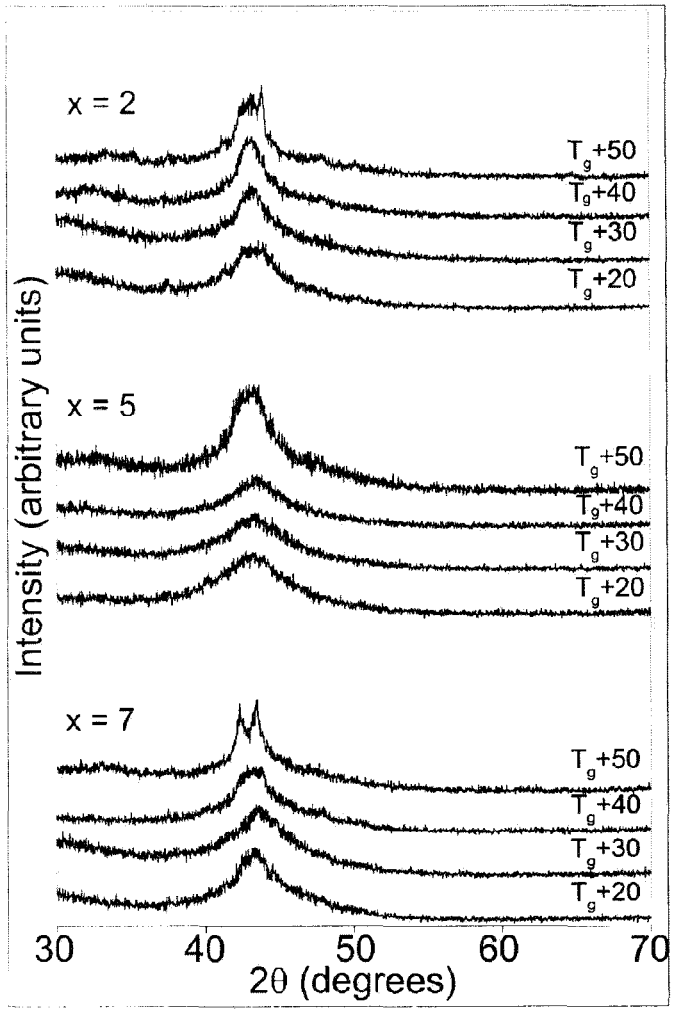
FIGS. 23(*a*) and (*b*) show more X-ray patterns for multiphase composite alloys.

Each of the alloys demonstrated a strong retention of amorphous behavior up to Tx as exemplified by the XRD spectra shown in FIG. 23A. The best glass former ($Fe_{62}C_{10}B_9Mo_{12}Cr_4W_3$) is shown along with the amorphous compositions on either extreme of the compositional spectrum ($Fe_{60}C_{10}B_9Mo_{14}Cr_4W_3$ and $Fe_{65}C_{10}B_9Mo_9Cr_4W_3$). Those alloys with ΔTx regions less than 50K experienced some loss of amorphous behavior at the Tg+50 anneal condition. The crystalline peaks beginning to form coincide with the composition dependent initial crystalline phase, which will be discussed with the next set of heat treatments. $Fe_{62}C_{10}B_9Mo_{12}Cr_4W_3$ had a ΔT of 51 K and retained its fully amorphous structure through the Tg+50 anneal treatment of 10 minutes.

It is worthwhile to note that the formability of a BMG is greatly enhanced when forming occurs at the upper extreme of the supercooled liquid region because above Tg there is a steady increase in atomic mobility and associated decrease in viscosity, making the alloy softer. For this reason, alloys demonstrating good resistance to crystallization even near Tx are ideal for industrial applications.

The next set of heat treatments was performed to identify the crystalline phases that evolve from the amorphous state upon heating. Separate DSC anneals were performed to grow each crystalline phase that forms upon heating. All alloys from the $Fe_{67-x}C_{10}B_9Mo_{7+x}Cr_4W_3$ (x=1-7) system exhibit three distinct exothermic peaks in DSC corresponding to three separate crystalline phases. The DTA curve for $Fe_{62}C_{10}B_9Mo_{12}Cr_4W_3$ in FIG. 22 shows the 3 characteristic exothermic peaks for these alloys (peak onsets labeled Tx1, Tx2, and Tx3). To identify these phases, 120 minute anneals were performed at 5K below Tx1 , and at the offset temperatures of each crystalline phase. Offset temperatures were used rather than onset temperatures to ensure more complete crystallization of each phase.

The samples were then analyzed by X-ray diffractometry, and the peaks identified. The phase evolution for $Fe_{60}C_{10}N_9Mo_{14}Cr_4W_3$, $Fe_{62}C_{10}B_9Mo_{12}Cr_4W_3$, and $Fe_{65}C_{10}B_9Mo_9Cr_4W_3$ has been identified via XRD shown in FIG. 23B. Even after 120 minute heat treatments just before the onset of the first crystallization, each of these alloys demonstrates completely amorphous behavior, indicating excellent thermal stability across the compositional spectrum of this study.

The initial crystalline phase (Tx1) identified for all alloys in this study was $Fe_{23}(B,C)_6$. Although the evolution of the topology of Fe—B and Fe—C is vastly different on cooling from the liquid state, upon reheating, there is no significant driving force for the carbide or boride to nucleate before the other. The characteristic XRD peaks of $Fe_{23}B_6$ and $Fe_{23}C_6$ are very close together. The crystalline peaks from the initial phase of this study are not exclusively from the boride or carbide, but rather lie in between, indicating that either both are present, or more likely that a ternary $Fe_{23}(C,B)_6$ phase exists. Most Fe-based BMGs in the literature contain only boron and feature an initial crystalline phase of $Fe_{23}B_6$. Although not as effective as boron in facilitating glass formation in Fe-based systems, carbon is useful because, while minimizing materials costs, good glass-forming ability can be retained as long as a critical amount of boron is kept in the alloy (9 at. % in this implementation). The second crystallization corresponds to the phase $Fe_4W_2C$, while the third crystallization corresponds to $Mo_5Cr_6Fe_{18}$.

Figure 23B:
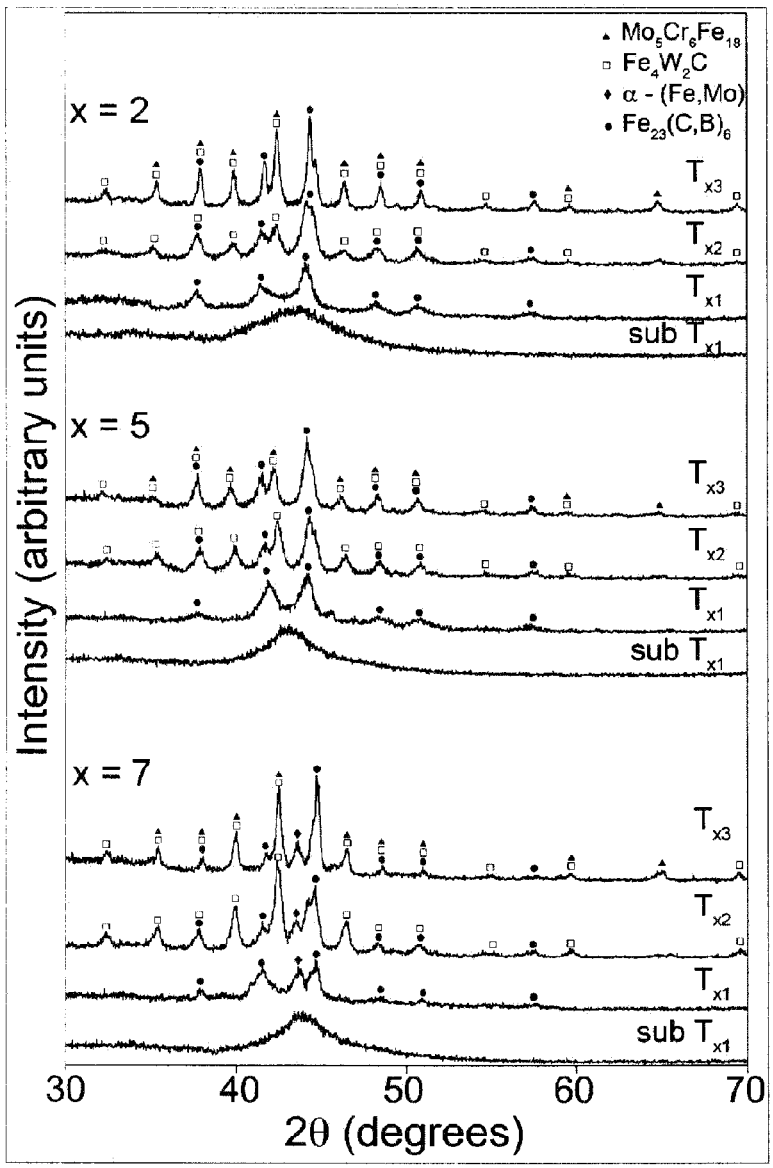

Although the same three crystalline phases nucleate out of each composition, there is one distinct difference in the phase evolution that arises from the compositional variation in $Fe_{67-x}C_{10}B_9Mo_{7+x}Cr_4W_3$. There is a transition from a two-phase primary crystallization at high Mo content, to a single-phase primary crystallization. A comparison of the XRD spectra for Tx1 anneals, seen if FIG. 23B, shows a peak corresponding to α-(Fe,Mo) observed in $Fe_{60}C_{10}B_9Mo_{14}Cr_4W_3$, in addition to $Fe_{23}(C,B)_6$, which is not present in $Fe_{62}C_{10}B_9Mo_{12}Cr_4W_3$ or $Fe_{65}C_{10}B_9Mo_9Cr_4W_3$.

An analysis of the peak widths from the X-ray analysis also revealed a distinct difference in crystallite size after 120 minute anneals, which reinforces the compositional dependence of GFA and the resistance to crystallization. Peak broadening was approximated using a Pearson-VII distribution applied to XRD spectra for Tx3 anneals, and crystallite size estimated using the Williamson Hall method with MDI's Jade software. The most significant peak broadening was observed in $Fe_{62}C_{10}B_9Mo_{12}Cr_4W_3$, which had an average crystallite size of 35 nm. $Fe_{60}C_{10}B_9Mo_{14}Cr_4W_3$ and $Fe_{65}C_{10}B_9Mo_9Cr_4W_3$ exhibited less peak broadening, resulting in calculated crystallite sizes of 60 nm and 55 nm, respectively.

These differences are related to the optimization of elastic strain as dictated by the Mo content in each alloy. An optimum Mo content kinetically hinders the tendency for Fe—B and Fe—C ordering, thus suppressing $Fe_{23}(C,B)_6$ for longer times. When the Mo content is greater than the optimum value of 12 at. %, a slightly different phase evolution is observed. Mo in effect supersaturates the disordered structure and upon reheating, the excess Mo comes out leading to a primary crystallization featuring a mixture of α-(Fe,Mo), and $Fe_{23}(C,B)_6$. The phase evolution for $Fe_{65}C_{10}B_9Mo_9Cr_4W_3$ is identical to that of $Fe_{62}C_{10}B_9Mo_{12}Cr_4W_3$, however a notably larger crystallite size was observed. The low atomic mobility of Mo minimizes crystallite size in the optimum composition, and as the Mo content is decreased, atomic mobility increases, permitting crystallites to grow larger in size upon annealing. The stepwise adjustment of Mo content leads to a stepwise change in elastic strain and thus a variation in constraint on crystallite size. This type of complexity in crystalline phase evolution offers versatility in microstructure type and size that can be utilized in a multitude of applications.

Differential thermal analysis (DTA) was also performed to further characterize the kinetics of the amorphous to crystalline transition. DTA combined with varying heating rates can be used to calculate the activation energy for crystallization in a glass. The following equation describes the shift of the peak temperature, Tp, with a change in the heating rate, ϕ, where Q is the activation energy:

$$Ln[\phi/(Tp)^2]=-Q/(RTp)+\text{constant}$$

Figure 24A:
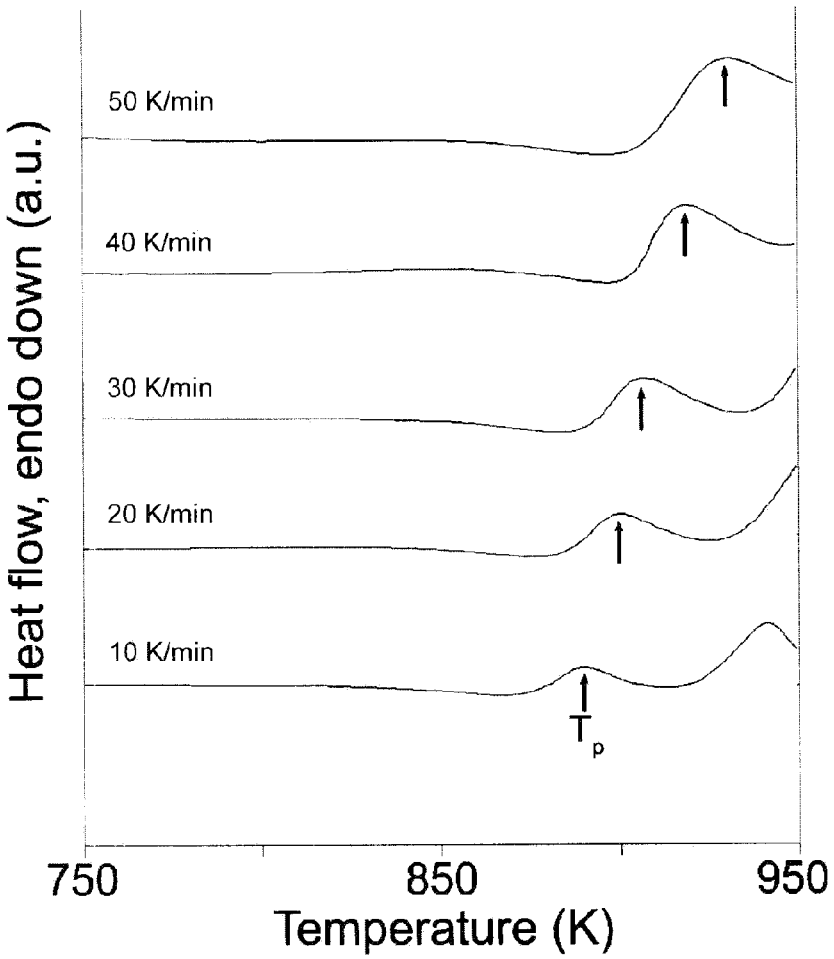
FIG. 24A shows more DSC traces of multi-phase composite alloys.
Figure 24B:
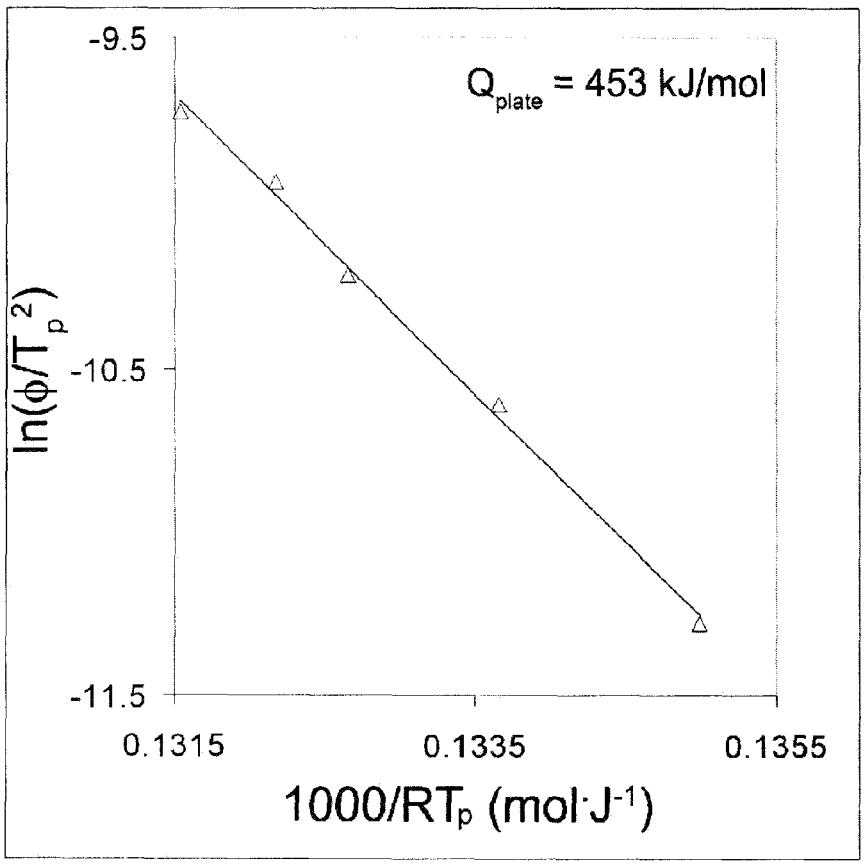
FIG. 24B shows an Arrhenius plot to determine activation energy of multi-phase composite alloys.

The peak temperatures are found at the maximum of the heat flow exotherm of the first crystallization at each heating rate shown in FIG. 24A. Using the peak temperatures and the equation above, an Arrhenius plot can be used to calculate the activation energy for crystallization, Q, as shown in FIG. 24B.

The activation energy for crystallization in this system compares favorably to that of other high Fe content BMGs, and numerous other documented BMG systems. The samples used to determine Q were 0.64 mm thick plates made via copper mold casting. Although there is no direct method to correlate activation energies for different alloy geometries, the activation energy depends on the alloy's cooling rate. The fact that the alloys in the current study have such high activation energies in the plate geometry is indicative of an alloy system with tremendous resistance to crystallization. These alloys compare even more favorably due to the significantly lower materials costs. A listing of the peak temperatures and activation energy for each alloy in the current study is shown in Table 3.3.

TABLE 3.3

| | Peak Temperature ($T_p$) in K at various heating rates | | | | | |
|---|---|---|---|---|---|---|
| | 10 K/min | 20 K/min | 30 K/min | 40 K/min | 50 K/min | Q (kJ/mol) |
| $Fe_{60}C_{10}B_9Mo_{14}Cr_4W_3$ | 903.1 | 914.8 | 922.4 | 931.4 | 938.4 | 305 |
| $Fe_{61}C_{10}B_9Mo_{13}Cr_4W_3$ | 898.9 | 912.7 | 920.5 | 925.9 | 932.8 | 324 |
| $Fe_{62}C_{10}B_9Mo_{12}Cr_4W_3$ | 891.0 | 899.9 | 906.7 | 910.0 | 914.4 | 453 |
| $Fe_{63}C_{10}B_9Mo_{11}Cr_4W_3$ | 884.1 | 891.6 | 899.9 | 904.6 | 909.3 | 402 |
| $Fe_{64}C_{10}B_9Mo_{10}Cr_4W_3$ | 879.6 | 887.8 | 895.2 | 901.3 | 905.6 | 388 |
| $Fe_{65}C_{10}B_9Mo_9Cr_4W_3$ | 869.3 | 879.7 | 888.2 | 892.4 | 896.5 | 364 |

The activation energy shows a unique trend that parallels the changes in supercooled liquid region. As described earlier, modeling predicted a minimization in Mo content for the best GFA. Our experiments revealed however, that there is an ideal Mo content that optimizes elastic strain in the amorphous structure resulting in a peak in the GFA at 12 at. % Mo. This peak also coincides with a maximum in activation energy significantly higher than the amorphous compositions surrounding it. Above this critical Mo content, GFA decreases, and there is a corresponding decrease in activation energy. A comparison of the alloys at the extremes of this substitutional system reveals that the low Mo content alloys investigated (x=1-4) have a significantly better resistance to crystallization than the alloys at the high end (x=6,7) of the Mo substitutional spectrum.

The sensitivity of the heat treatment process to time duration is characterized next. It is found that the duration of the heat treatment is a critical factor in achieving BMG matrix composites or fully nanocrystalline BMG derived materials. The heat treatment duration also provides a process parameter through which crystal size can be controlled. For example, the longer the anneal time, the larger the average crystal size.

Figure 25:
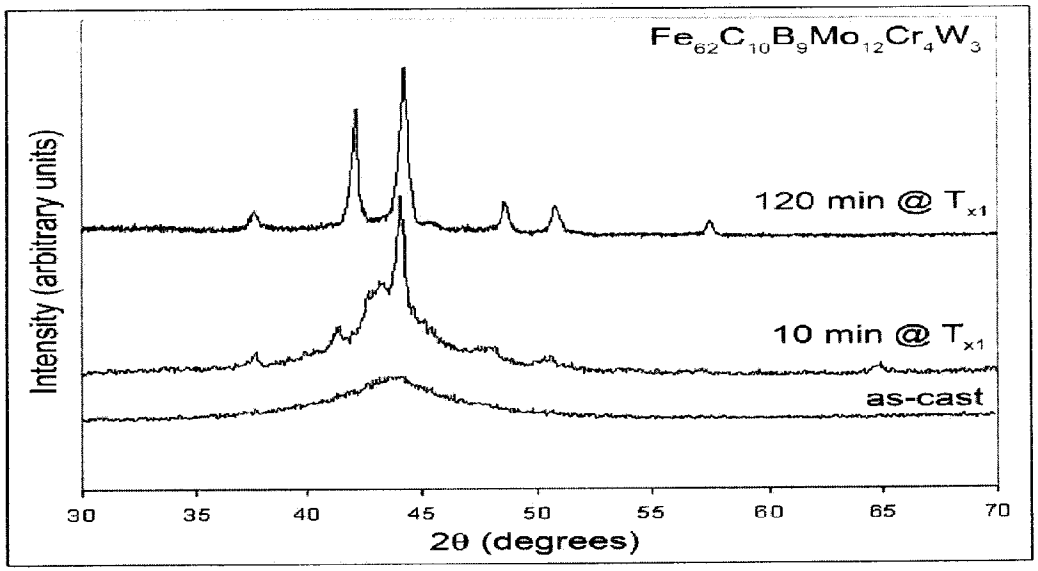
FIG. 25 shows X-ray patterns for a multi-phase composite alloy.

FIG. 25 shows a series of XRD spectra showing three different morphologies, resulting from different heating conditions. The as-cast bulk metallic glass has a broad hump indicative of a fully amorphous material. An initially amorphous sample of the same composition annealed for 10 minutes results in a nanocrystalline phase embedded within and amorphous matrix. This condition is indicated by the presence of small crystalline peaks superimposed over the broad hump indicating the presence of an amorphous phase. The top spectrum is the same composition annealed for 120 minutes. Under this condition, the broad hump no longer exists, only well defined crystalline peaks and a fully nanocrystalline BMG derived material.

The second fabrication process (ii) for multiple BMG materials is presented next. As part of this fabrication method, the solidification rate of the molten samples of BMG can be altered such that the amorphous structure is bypassed and a fully crystalline material results in which crystal size varies based on the rate of solidification. Fe-rich BMG in this composition space typically have critical cooling rates of 100 K/s. Cooling slower than 100 K/s will result in crystallization, with lower rates yielding coarser crystalline features. After carefully optimizing the fabrication process (ii), four cooling conditions were established.

The first condition of process (ii) includes a rapid quench at a cooling rate of 100 K/s. Depending on the composition and the thickness of the sample, it is possible to achieve fully amorphous or nanocrystalline/BMG matrix composite states.

The second condition of process (ii) includes a quench at an intermediate rate of 50 K/s. With the cooling rate below the critical level necessary to maintain amorphous behavior, a partially crystalline/BMG matrix composite results. Since the cooling rate is modestly fast with respect to BMG forming compositions, the kinetics of solidification restrict crystal growth to no more than 5 microns.

The third condition of process (ii) includes a quench at a slower intermediate cooling rate of about 25 K/s. At this condition, larger more complex crystalline structures begin to grow. Large dendritic structures and other large crystals in excess of 25 microns are uniformly distributed throughout this multi-phase BMG derived material.

The fourth condition of process (ii) includes a quench at a cooling rate for which the molten alloy is slowly and continuously cooled over a 60 s interval. The cooling rate was about 10 K/s. This condition led to the proliferation of eutectics throughout the specimen, in addition to prolonged diffusion of Mo into large plate-like crystals as large as 100 microns, with still other regions of peritectic growth from alternate crystalline phases. The four cooling conditions represent an evolution towards greater morphological complexity.

Figure 26:
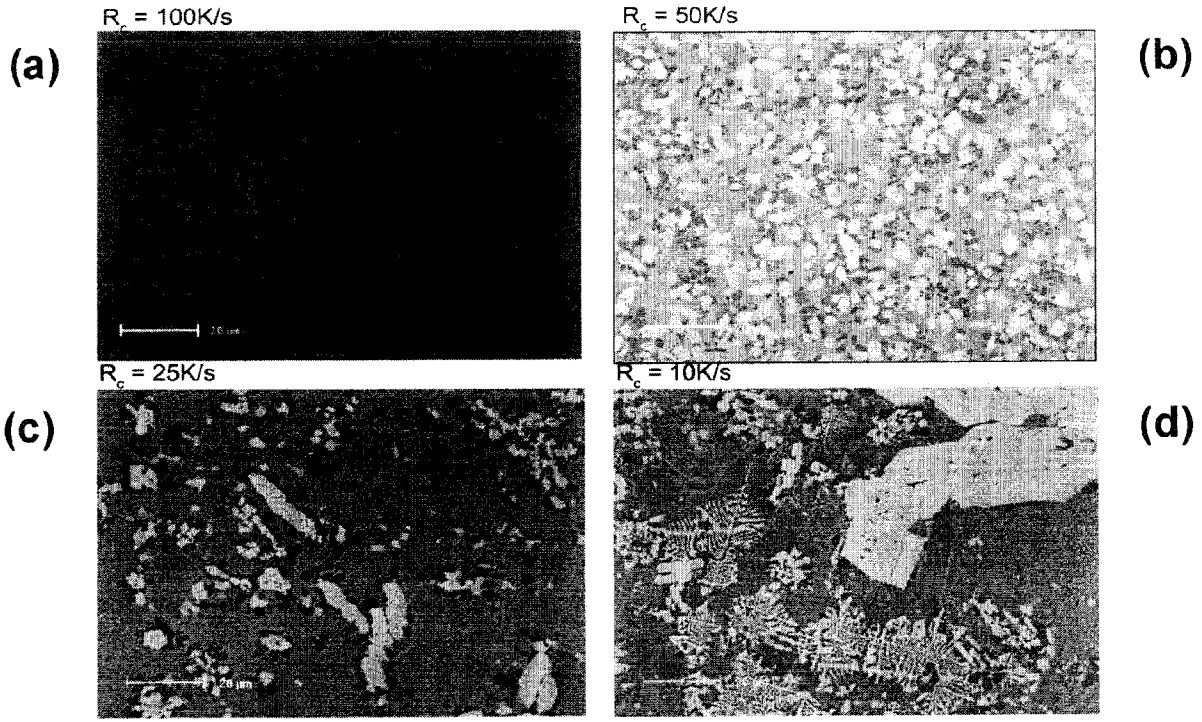
FIG. 26 shows microstructure of multi-phase composite alloys obtained by a novel fabrication process.

The micrographs in FIG. 26 illustrate morphologies of the BMG derived materials for each of the four previously identified conditions of fabrication process (ii).

The third fabrication process (iii) has also been characterized. This multi-step method to achieve multi-phase BMG derived materials starts with a glass-forming composition in powder form and the requires adding tungsten carbide (WC) powder.

Figure 27:
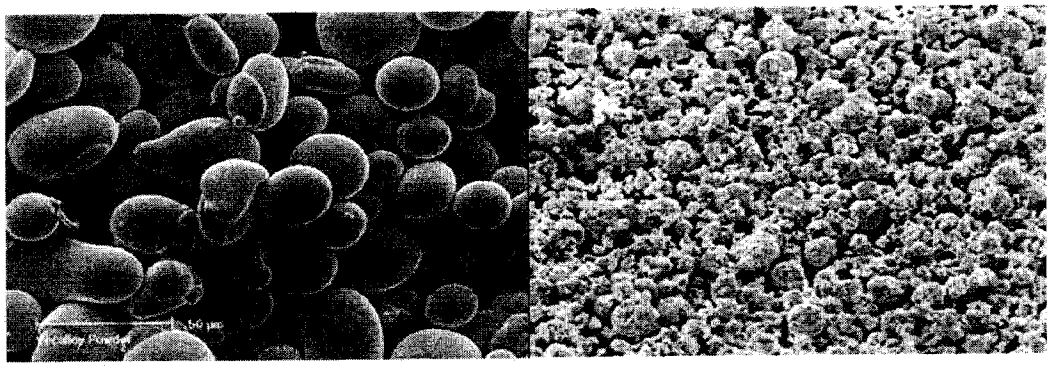
FIG. 27 shows microstructure of multi-phase composite alloys obtained by another novel fabrication process.

FIG. 27(*a*) shows micrographs of powderized Fe-rich BMG illustrating the material microstructure before the fabrication process (iii). FIG. 27(*b*) shows a BMG-WC composite resulting from the multi-step process of cold isotactic pressing, liquid phase sintering and quenching. Notable is the finer, more uniform post-process material structure illustrated in FIG. 27(*b*).

Thermal aging below the glass transition temperature improves mechanical properties, such as plasticity and mechanical hardness, via structural relaxation. To verify these properties, hardness testing was performed on samples annealed within the supercooled liquid region, where a strong retention of amorphous behavior was observed in this glass-forming system. Hardness tests were performed on various samples in accordance with the heat treatments from this study (alloys corresponding to x=2, 5, and 7 from $Fe_{67-x}C_{10}B_9Mo_{7+x}Cr_4W_3$ (x=1-7 at. %). Namely, hardness data was gathered for samples annealed for ten minutes at 10K intervals throughout the supercooled liquid region, and at each of the crystallization temperatures Tx1, Tx2, and Tx3. Additionally hardness data was gathered on samples annealed for 120 minutes at Tx1, Tx2, and Tx3; Table 3.4 summarizes the hardness results. Testing conditions for the $Fe_{67-x}C_{10}B_9Mo_{z+x}Cr_4W_3$ (x=2, 5, 7) alloy were Hv, L=1960 N.

TABLE 3.4

| | Mo concentration | | |
|---|---|---|---|
| Temperature differential | x = 2 | x = 5 | x = 7 |
| $T_g$+20 K | 1452 | 1439 | 1576 |
| $T_g$+30 K | 1474 | 1458 | 1607 |
| $T_g$+40 K | 1489 | 1490 | 1671 |
| $T_g$+50 K | 1503 | 1504 | 1711 |
| sub$T_{x1}$_10 m | 1521 | 1533 | 1703 |
| $T_{x1}$_10 m | 1597 | 1744 | 1774 |
| $T_{x1}$_120 m | 1574 | 1754 | 1753 |
| $T_{x2}$_10 m | 1659 | 1932 | 1862 |
| $T_{x2}$_120 m | 1627 | 1864 | 1846 |
| $T_{x3}$_10 m | 1890 | 2009 | 2104 |
| $T_{x3}$_120 m | 1858 | 1911 | 1953 |

There is a slight increase in hardness as the temperature is increased within the supercooled liquid region in each alloy. Recall from FIG. 23A, it was shown that alloys corresponding to x=2, 5, and 7 retain fully amorphous structure throughout the supercooled liquid region. Thus, the increase in hardness in the supercooled liquid region is likely on account of densification due to structural relaxation and free volume annihilation. Alloys on the outer extremes of the substitutional spectrum tended to crystallize at Tg+50K. This crystallization manifests itself as a larger jump in hardness at Tg+50, observed in alloys (x=2) and (x=7) than was observed in (x=5), where the alloy remained fully amorphous after the same heat treatment, because the initial crystalline phase, $Fe_{23}(C,B)_6$, proved to be harder than the fully amorphous alloy.

The nucleation of the initial crystalline phase, $Fe_{23}(C,B)_6$, results in a marked increase in hardness over the fully amorphous alloy. The data for the three different alloys indicate that while the nucleation of $Fe_{23}(C,B)_6$ does increase the hardness, there is an additional dependence on the Mo content of the alloy as well. The second crystallization, corresponding to the nucleation of $Fe_4W_2C$ imparts tremendous structural reinforcement to the surrounding matrix. $Fe_{62}C_{10}B_9Mo_{12}Cr_4W_3$ had an average hardness of 1932 after the Tx2 heat treatment. The high ratio of tungsten in this phase likely accounts for its high hardness. For each of the alloys in this study, Tx3 corresponded to the nucleation of the phase $Mo_5Cr_6Fe_{18}$.

This phase further enhanced the hardness of the alloys in this system, resulting in hardness exceeding 2000 Vickers for alloys containing more than 12 at. % Mo. The crystal size of these precipitated phases was not large enough to resolve via optical microscopy or scanning electron microscopy, and therefore hardness testing was not performed on individual phases. The data clearly indicates that the nucleation of each phase results in a marked change in the hardness of each alloy, and there is a clear dependence of hardness on the Mo content of the alloy. The high fraction of Mo present in the phase corresponding to Tx3 results in the exhaustion of available Mo in the matrix at successively lower volume fractions of $Mo_5Cr_6Fe_{18}$, as Mo content is decreased. The effect of this is the successively lower hardness observed in $Fe_{60}C_{10}B_9Mo_{14}Cr_4W_3$, $Fe_{62}C_{10}B_9Mo_{12}Cr_4W_3$, and $Fe_{65}C_{10}B_9Mo_9Cr_4W_3$. Since less Mo is available for phase formation, a larger volume fraction of the Mo-depleted matrix, with presumably lower hardness, is present. It can therefore be inferred that $Mo_5Cr_6Fe_{18}$ is in fact even harder than the 2000 Vickers hardness values would indicate, since this must also incorporate the Mo-depleted matrix.

Furthermore, Table 3.5 represents alloy hardness for the four different cooling conditions of fabrication process (ii) presented above. Only the fastest cooling rate results in a fully amorphous specimen. There is significant variation in the BMG derived composite hardness values due to crystal size and atomic diffusion. None of the four conditions result in the same BMG derived composite, neither morphologically, nor compositionally. Crystal sizes vary, as do phase compositions. The disparity between the BMG-derived composite and the Mo-rich crystals tends to grow with decreasing cooling rates because the low cooling rates allow more of the very hard Molybdenum to diffuse out of the bulk and into these extremely hard secondary phase crystals. The table below presents measurements for the alloy composition $Fe_{57}C_9B_{11}Mo_{12}Cr_8W_3$ under conditions given by Hv, L=200 N. The abbreviations in the table header are: FA=Fully amorphous, BMGDC=BMG-derived composite, and MRC=Mo-rich crystal.

TABLE 3.5

| $R_c$ (K/s) | FA | BMGDC | MRC |
|---|---|---|---|
| 100 | 1851.8 | 1758 | — |
| 50 | — | 1631.8 | 2430.8 |
| 25 | — | 1716.6 | 2505.2 |
| 10 | — | 1421 | 2812.6 |

In summary, only a few implementations are disclosed. However, it is understood that variations and enhancements may be made. Additional information related to the implementations disclosed in this application is described in "Modeling the glass forming ability of metals" by Justin Lee Cheney, Ph.D. Thesis—University of California, San Diego, 2007, the entire disclosure of which is incorporated by reference. Further additional information related to the implementations disclosed in this application is described in "Devitrification and Cooling Rate Effects on Microstructure and Mechanical Properties in $Fe_{57}C_9B_{11}Mo_{12}Cr_8W_3$" by Hesham Khalifa and Kenneth Vecchio, accepted for publication in Advanced Engineering Materials, 2009, the entire disclosure of which is incorporated by reference.

While this specification contains many specifics, these should not be construed as limitations on the scope of any invention or of what may be claimed, but rather as descriptions of features specific to particular implementation. Certain features that are described in this application in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular implementations have been described. Variations, enhancements, and other implementations can be made based on what is described and illustrated.

What is claimed is what is described and illustrated, including:

1. A metallic glass material, comprising:

$Fe_{100-a-b-c-d-e}B_aSi_bCr_cNb_dW_e$, where a +b is the non-metal/metalloid concentration and is less than or equal to 24, 'a' ranges from 14 to 24, 'b' is from 2 to 8, 'c' from 2 to 18, 'd' from 3 to 14, and e from 0 to 2 such that the atomic percent of iron must equal or exceed 50 at. %.

2. The material in claim 1, wherein a composition of the material is $Fe_{54}Cr_{17}Nb_9B_{16}Si_4$.

* * * * *